US008166625B2

(12) United States Patent
Williams

(10) Patent No.: US 8,166,625 B2
(45) Date of Patent: May 1, 2012

(54) CONTINUOUS DIORAMA AND METHOD OF MAKING THE SAME

(75) Inventor: Anthony D. Williams, San Carlos, CA (US)

(73) Assignee: Axial-Digital Corp., San Carlos, CA (US)

( * ) Notice: Subject to any disclaimer, the term of this patent is extended or adjusted under 35 U.S.C. 154(b) by 43 days.

(21) Appl. No.: 12/844,075

(22) Filed: Jul. 27, 2010

(65) Prior Publication Data

US 2012/0028233 A1 Feb. 2, 2012

(51) Int. Cl.
*B21D 39/02* (2006.01)
*G09B 25/00* (2006.01)

(52) U.S. Cl. ..... 29/463; 434/428

(58) Field of Classification Search ..... 29/401.1, 29/463, 462, 428; 400/124.14, 800; 434/428; 40/124.14
See application file for complete search history.

(56) References Cited

U.S. PATENT DOCUMENTS

| | | | | |
|---|---|---|---|---|
| 1,215,962 | A | 2/1917 | Morrison et al. | |
| 1,853,615 | A | 4/1932 | Howard | |
| 2,059,964 | A | 11/1936 | Hempstone | |
| 2,102,553 | A | 12/1937 | Cohen | |
| 2,154,087 | A | 4/1939 | Fawcett | |
| 2,312,644 | A | 3/1943 | Horr | |
| 2,314,721 | A | 3/1943 | Lowenstein | |
| 2,731,748 | A | 1/1956 | Polay | |
| 3,363,360 | A | 1/1968 | Ryan | |
| 3,664,049 | A | 5/1972 | Smith | |
| 4,146,984 | A | 4/1979 | Lindquist | |
| 4,778,392 | A | 10/1988 | Mitchell | |
| 5,317,823 | A | 6/1994 | Brunt, II | |
| 6,173,515 | B1 | 1/2001 | Walsh | |
| 6,249,278 | B1 | 6/2001 | Segan et al. | |
| 6,606,407 | B1 | 8/2003 | Takahashi et al. | |
| 7,258,592 | B2 | 8/2007 | Colak | |
| 8,046,894 | B2 * | 11/2011 | Williams | 29/463 |
| 2002/0110652 | A1 | 8/2002 | Conk | |
| 2004/0190063 | A1 | 9/2004 | Brown | |
| 2005/0099414 | A1 | 5/2005 | Kaye et al. | |
| 2006/0046603 | A1 | 3/2006 | Colak | |
| 2007/0240345 | A1 | 10/2007 | Davis | |
| 2008/0178501 | A1 | 7/2008 | Crowell et al. | |
| 2008/0253608 | A1 | 10/2008 | Long et al. | |

* cited by examiner

*Primary Examiner* — John C Hong
(74) *Attorney, Agent, or Firm* — Edward S. Wright

(57) ABSTRACT

Diorama having a focal zone and a plurality of inclined panels on which different areas of the image are displayed disposed about the focal zone, with the image flowing continuously between the panels and no physical seams between areas of the image displayed on adjacent ones of the panels. The diorama is created from a two-dimensional image by constructing a layout guide in the form of a two-dimensional projection of the diorama with guide lines diverging outwardly from the focal zone and outlining the projected panels, superimposing the layout guide on the two-dimensional image with the focal zone in registration with a focal area of the image, selecting areas of the image for display on the panels of the diorama, creating an adjusted image having panels in which the selected areas are adjusted in size and/or shape to fit precisely within the guide lines for the panels of the diorama, selecting an anchor panel which remains fixed in place with the focal area of the adjusted image, rotating the other panels of the adjusted image about the focal area from a seam line toward the anchor panel to separate the image at the seam line and bring facing edges of adjacent ones of the image panels together to form an image that extends continuously across the panels from one side of the seam line to the other, printing the image with the rotated panels, trimming the printed image along facing edges of the image where it was separated at the seam line, and bringing the trimmed edges together along the seam line to form a three-dimensional image.

18 Claims, 28 Drawing Sheets

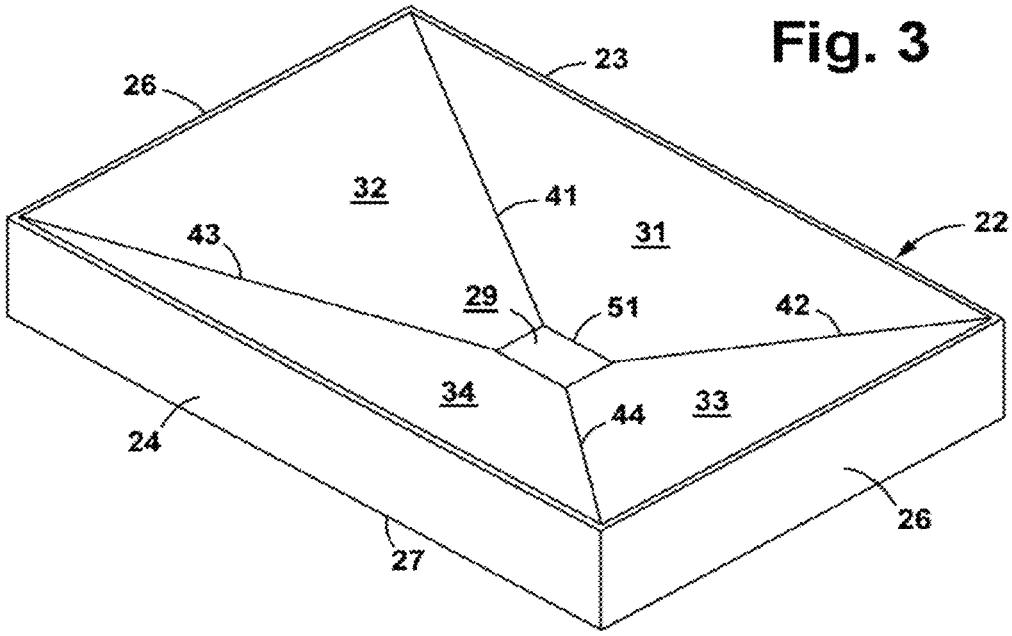
Fig. 3
Fig. 4
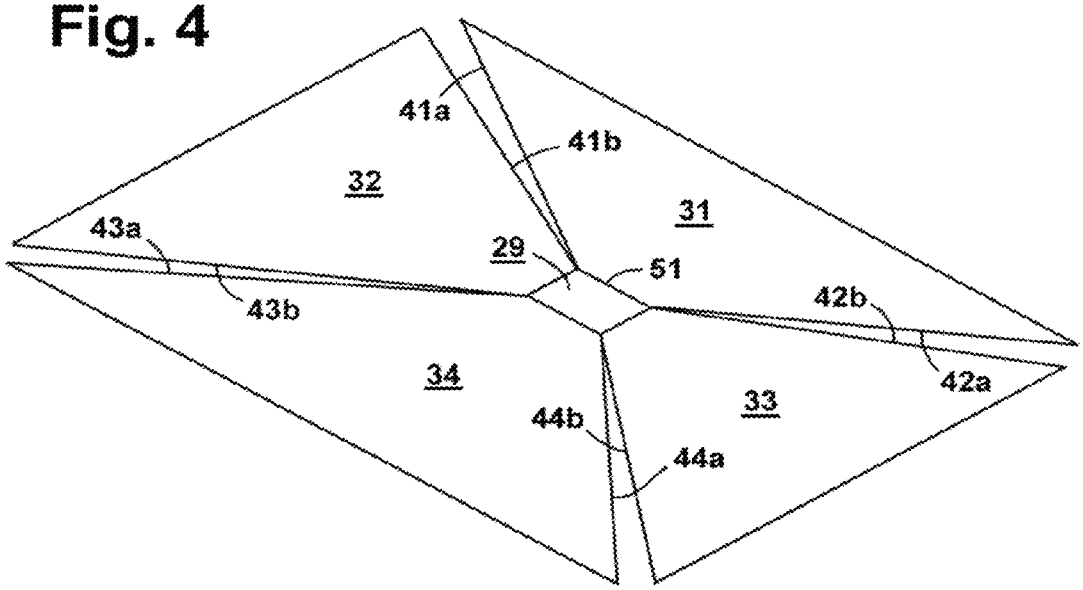

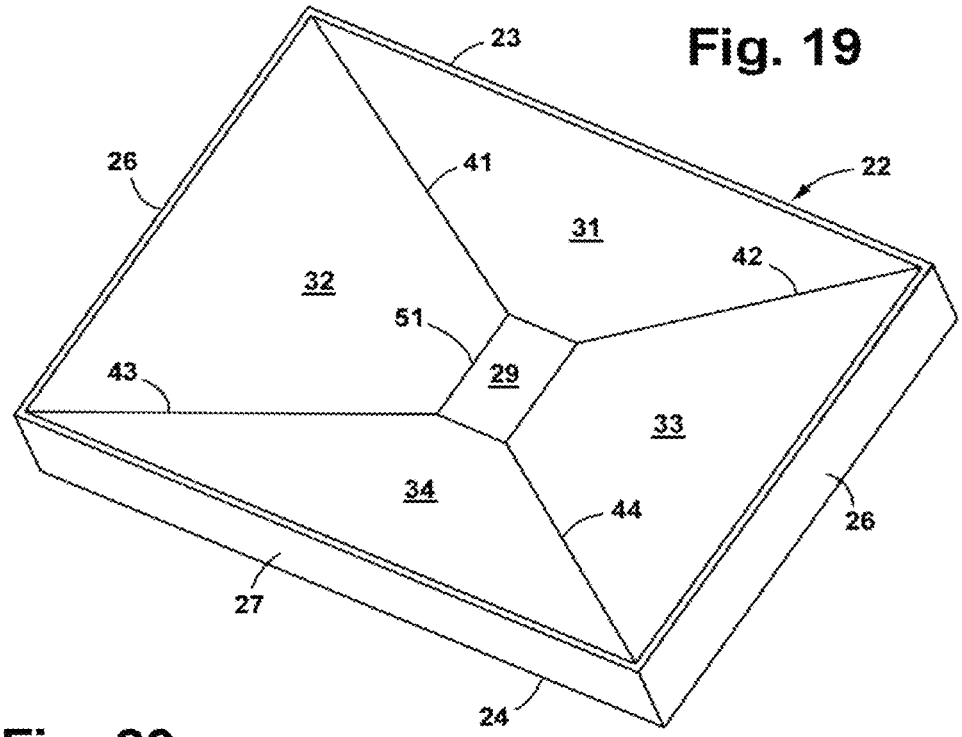
Fig. 19
Fig. 20
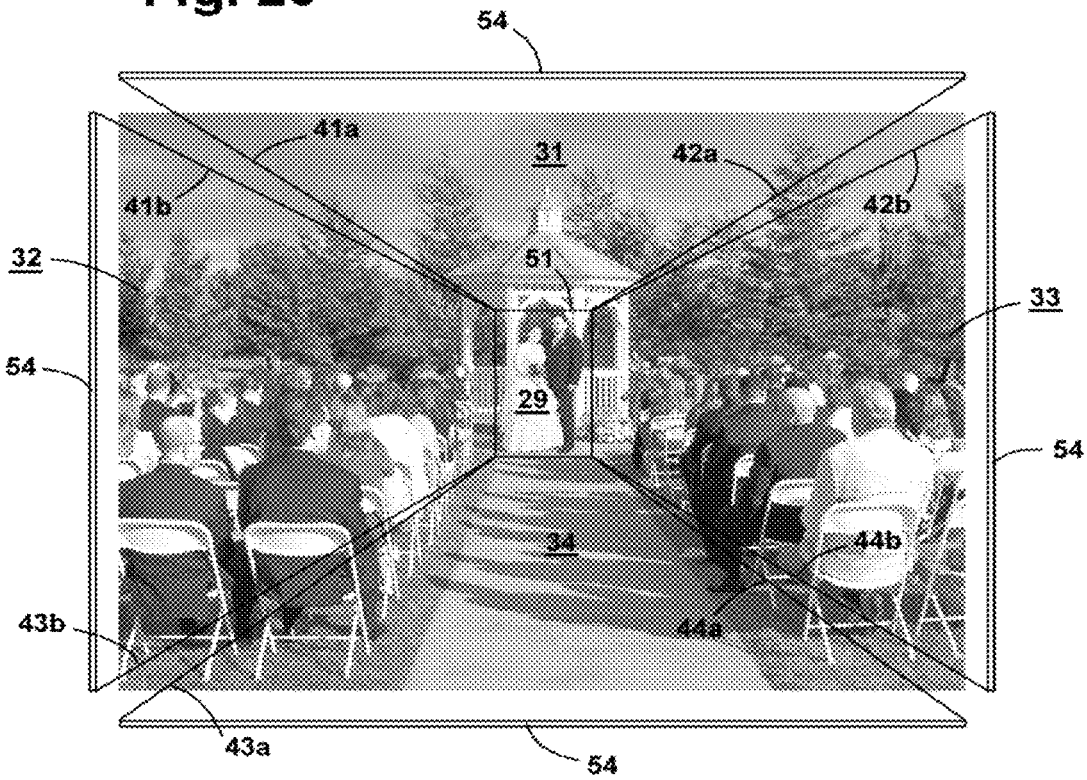

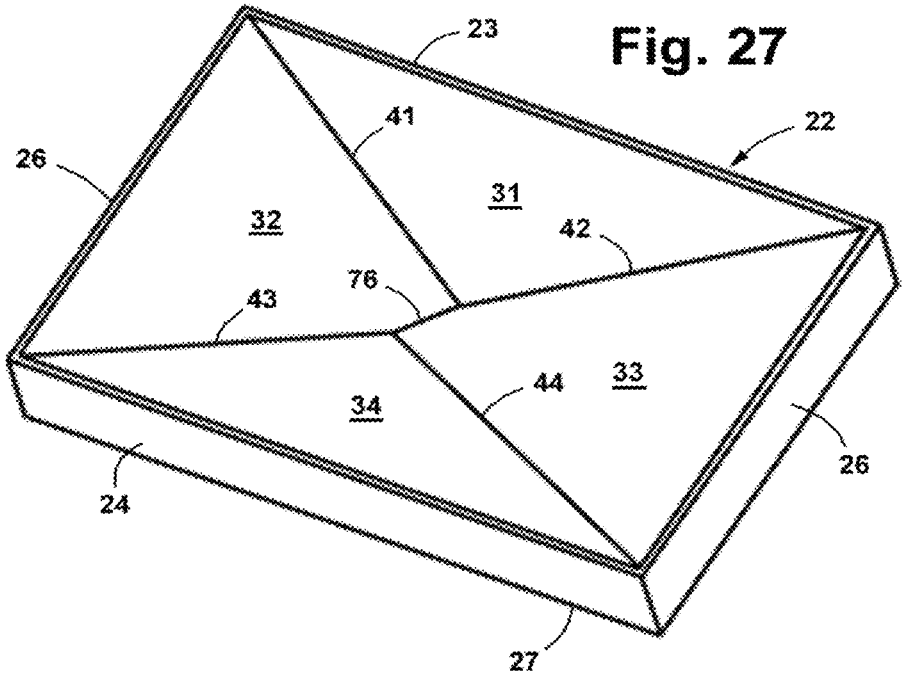
Fig. 27
Fig. 28
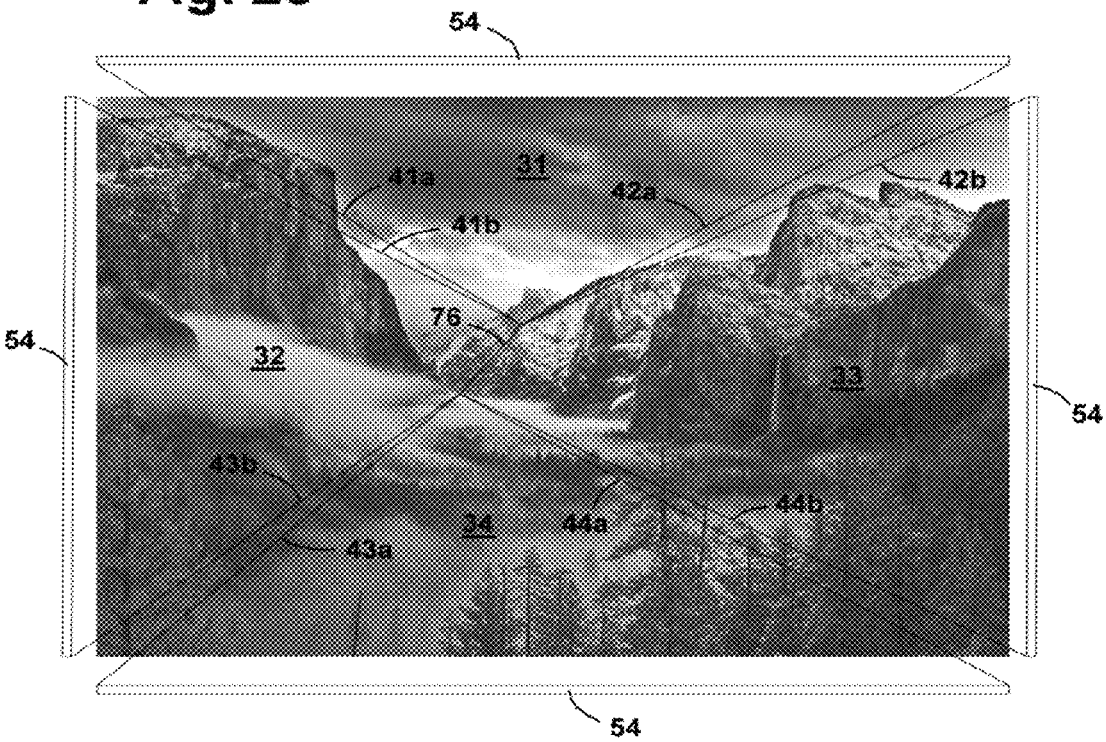

Fig. 33
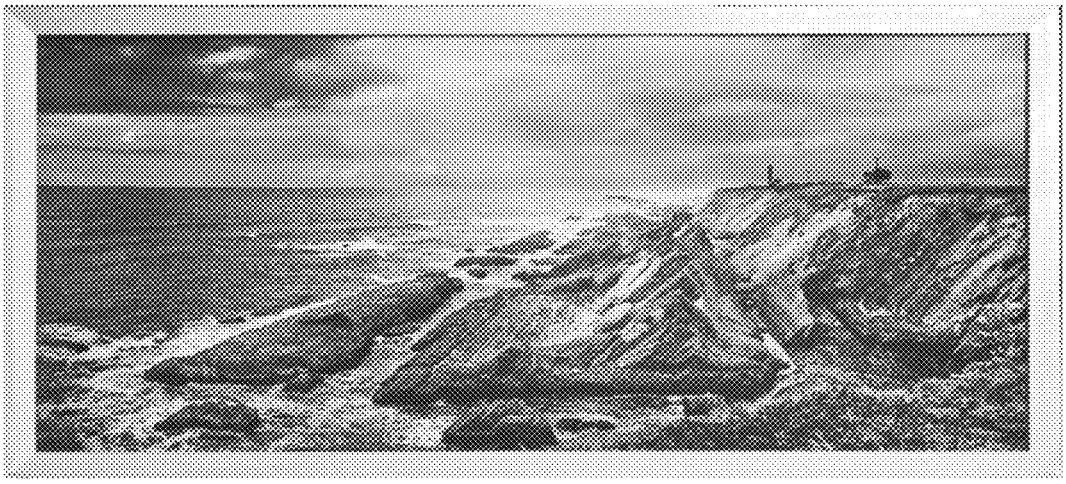
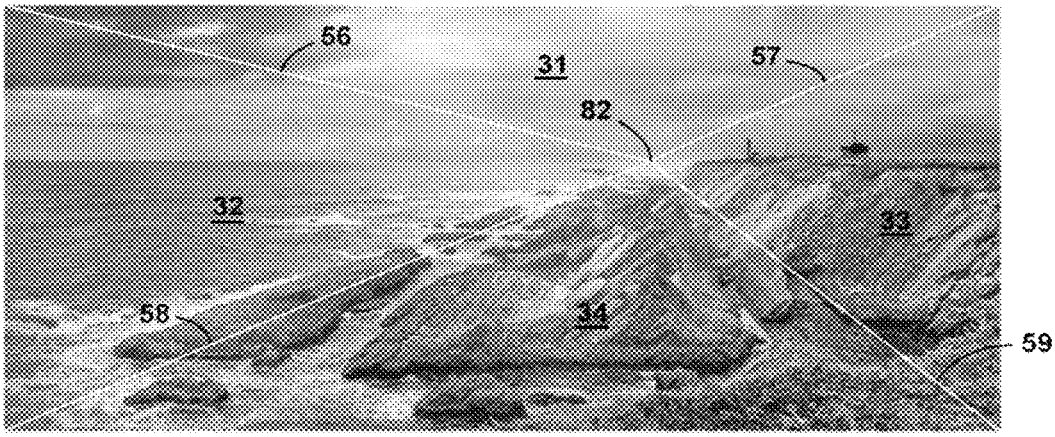
Fig. 34

26
41
23
32
31
43
82
42
34
33
26
24
44
27

54
41a
31
42a
41b
82
42b
54
32
33
54
44b
43b
34
44a
43a
54

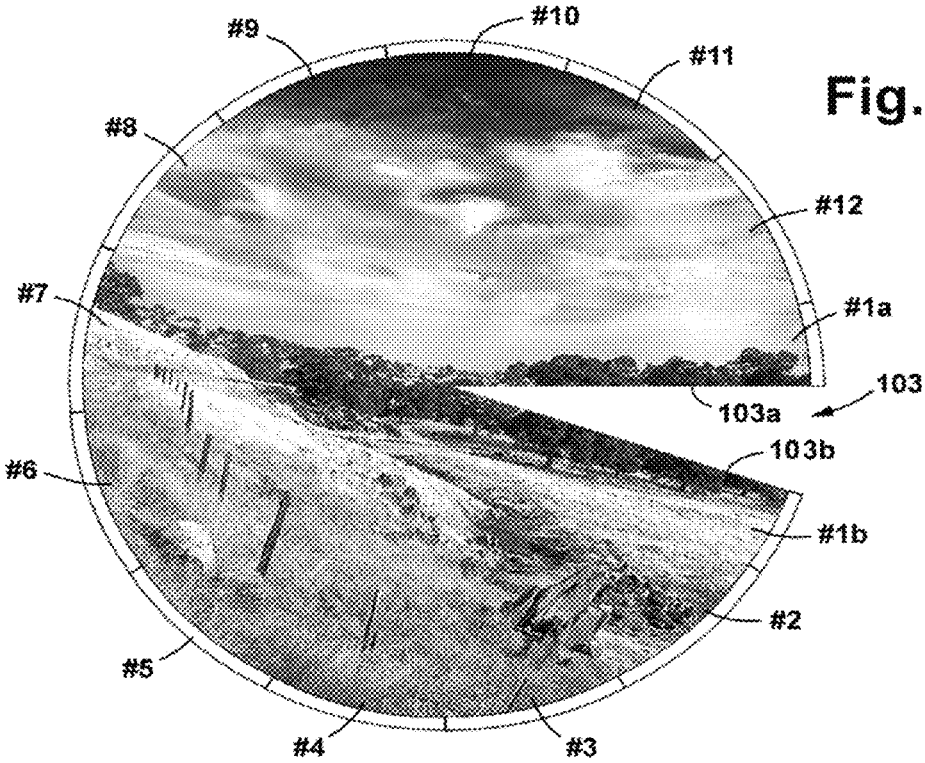
Fig. 56
Fig. 57
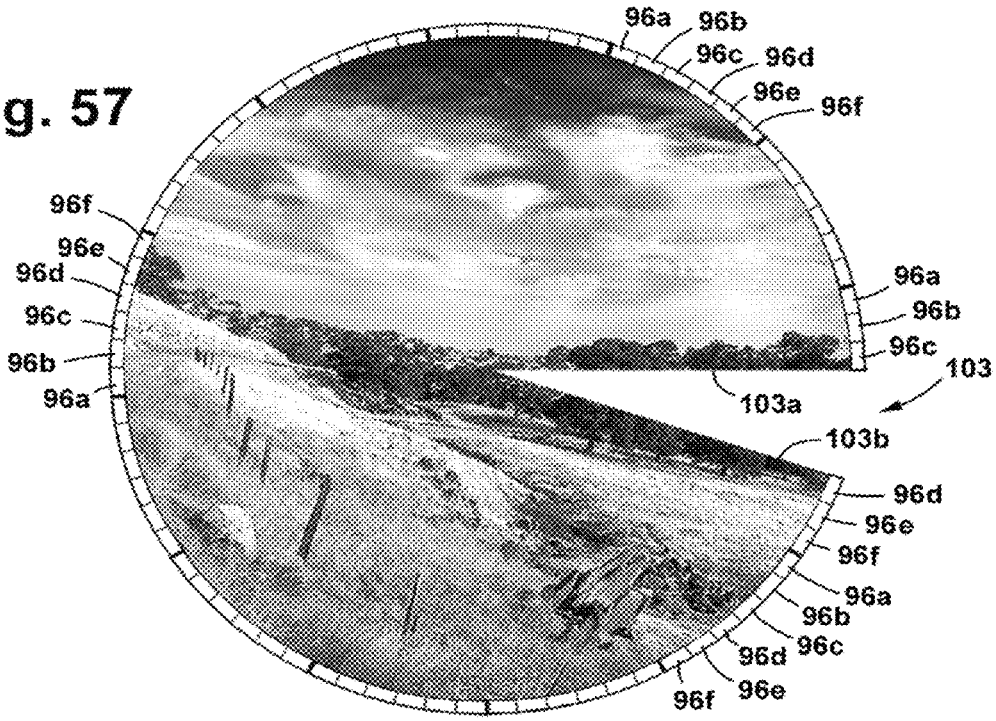

CONTINUOUS DIORAMA AND METHOD OF MAKING THE SAME

BACKGROUND OF THE INVENTION

1. Field of Invention

This invention pertains generally to three-dimensional images and, more particularly, to a diorama and method of making the same.

2. Related Art

The earliest dioramas were in the form of large images used in theaters. They were printed and/or painted on thin gauze curtains that allowed the theater operators to change the light intensity in front of or behind the gauze curtains, thus changing the mood of the display.

Modern dioramas are typically in the form of three dimensional models, both full and scaled sizes, utilizing three dimensional models of persons and other objects positioned, sometimes on scaled terrain, in front a background image to produce a three-dimensional effect. Such dioramas are sometimes placed in shadow boxes, but fail to provide a true perspective effect.

Application Ser. No. 12/539,485, filed Aug. 11, 2009, and Ser. No. 12/646,597, filed Dec. 23, 2009, disclose a new type of dioramas which a realistic perspective effect is created by dividing a two-dimensional image into areas which are displayed on mutually inclined panels having diverging edges which are drawn together so that the image flows continuously between the panels. While such dioramas can greatly enhance the depth and perspective of an image, accurate alignment of portions of objects appearing in adjoining panels can be difficult, and the physical seams between the panels can detract from the appearance of the diorama.

OBJECTS AND SUMMARY OF THE INVENTION

It is, in general, an object of the invention to provide a new and improved diorama and method of making the same.

Another object of the invention is to provide a diorama and method of the above character which overcome the limitations and disadvantages of dioramas heretofore provided.

These and other objects are achieved in accordance with the invention by providing a diorama and method in which the diorama has a focal zone and a plurality of inclined panels on which different areas of the image are displayed disposed about the focal zone, with the image flowing continuously between the panels and no physical seams between areas of the image displayed on adjacent ones of the panels.

The diorama is created from a two-dimensional image by constructing a layout guide in the form of a two-dimensional projection of the diorama with guide lines diverging outwardly from the focal zone and outlining the projected panels, superimposing the layout guide on the two-dimensional image with the focal zone in registration with a focal area of the image, selecting areas of the image for display on the panels of the diorama, creating an adjusted image having panels in which the selected areas are adjusted in size and/or shape to fit precisely within the guide lines for the panels of the diorama, selecting an anchor panel which remains fixed in place with the focal area of the adjusted image, rotating the other panels of the adjusted image about the focal area from a seam line toward the anchor panel to separate the image at the seam line and bring facing edges of adjacent ones of the image panels together to form an image that extends continuously across the panels from one side of the seam line to the other, printing the image with the rotated panels, trimming the printed image along facing edges of the image where it was separated at the seam line, and bringing the trimmed edges together along the seam line to form a three-dimensional image.

BRIEF DESCRIPTION OF THE DRAWINGS

FIGS. 3 and 4 are isometric views illustrating some of the steps in a preferred method of constructing a layout guide for use in making the diorama in the embodiment of FIG. 1.

FIG. 19 is an isometric view of a three-dimensional model used in constructing a layout guide for use in a preferred method of making the diorama in the embodiment of FIG. 1.

FIG. 20 is a plan view illustrating use of the layout guide in creating a perspective adjusted two-dimensional image for use in the diorama in the embodiment of FIG. 17.

FIG. 27 is an isometric view of a three-dimensional model used in constructing a layout guide for use in a preferred method of making the diorama in the embodiment of FIG. 25.

FIG. 28 is a plan view illustrating use of the layout guide in creating a perspective adjusted two-dimensional image for use in the diorama in the embodiment of FIG. 25.

FIG. 33 is a front elevational view of another embodiment of a diorama according to the invention, mounted in a frame.

FIG. 34 a plan view of the original photograph displayed on the diorama in the embodiment of FIG. 33, with lines added to indicate the focal zone and the areas of the image to be displayed on the panels of the diorama.

FIG. 56 is a plan view of the fully adjusted two-dimensional image for use in the diorama in the embodiment of FIG. 41.

FIG. 57 is plan view of the diorama in the embodiment of FIG. 41 in a flattened state.

DETAILED DESCRIPTION

Figure 1:
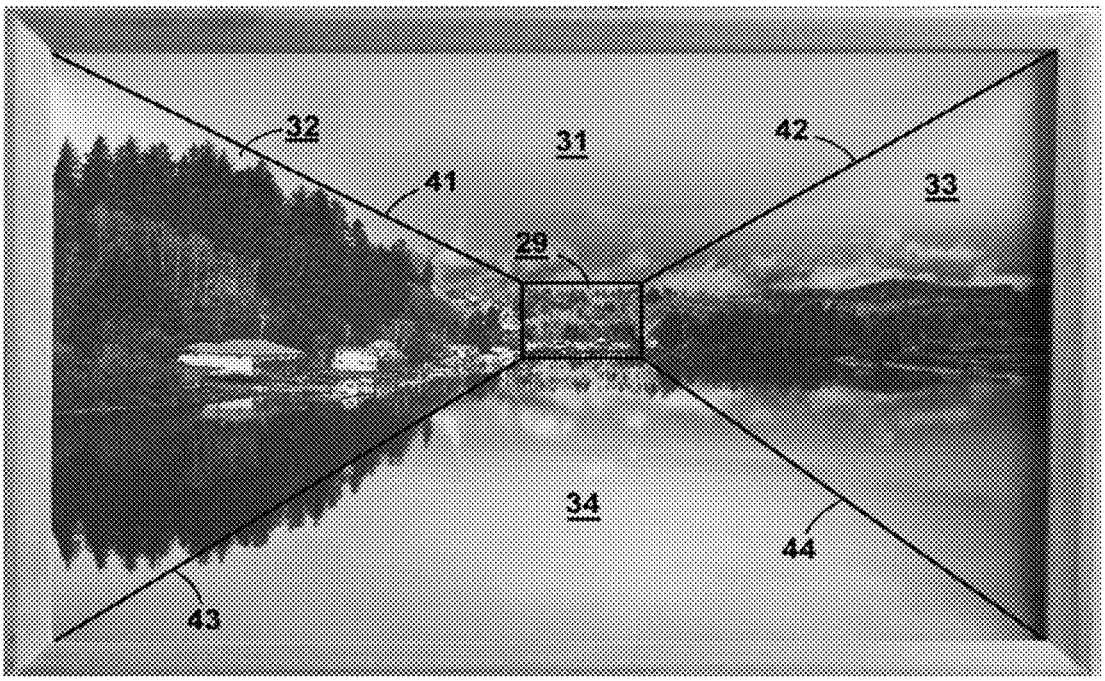
FIG. 1 is a front elevational view of one embodiment of a diorama according to the invention, mounted in a frame, with reference lines added to indicate different panels of the diorama.
Figure 2:
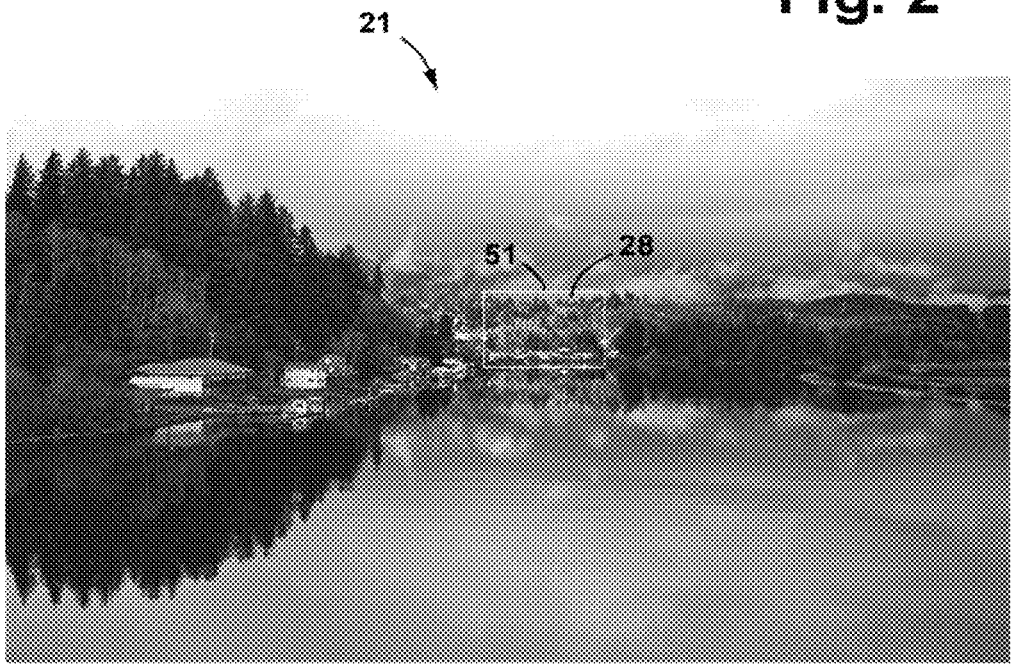
FIG. 2 a plan view of the original photograph displayed on the diorama in the embodiment of FIG. 1, with reference lines added to indicate the focal or background area of the image depicted therein.

As illustrated in FIGS. 1-3, the diorama comprises a two-dimensional image 21 which has been adjusted and configured for three-dimensional display in a frame or container 22. The image can be of any desired subject, and typically is a photographic image, although it can also be a drawing, painting, or other form of image, if desired. In this embodiment, the frame or container is illustrated as being a five-sided, rectangular shadow box having an upper wall 23, a lower wall 24, side walls 26, 26, a rear wall 27, and an open front.

An area of the image to which attention is to be drawn is selected as a focal area 28 for display in a central location or focal zone toward the rear of the diorama. In this particular embodiment, the focal area is a rectangular area that is displayed on a rectangular focal panel 29 toward the rear of the box, and the rest of the image is displayed on additional panels which extend between the edges of the focal panel and the corresponding edges at the front of the box. In this example, the additional panels include a top panel 31 which extends between the upper edge of the rectangular focal panel and the front edge of the upper wall of the box, side panels 32, 33 which extend between the side edges of the focal panel and the front edges of the sides of the box, and a lower panel 34 which extends between the lower edge of the focal panel and the front edge of the lower wall of the box.

Panels 31-34 extend from the plane of focal panel 29 at angles on the order of 30-45 degrees relative to the rear wall of the box, with adjacent ones of the panels coming together in the areas between the corners of the focal panel and the front corners or edges of the box. Thus, the top panel and the side panels come together in the areas indicated generally by lines 41, 42 which extend between upper corners of the focal panel and the upper front corners of the box, and the side panels and the lower panel come together in the areas indicated generally by lines 43, 44 which extend between lower corners of the focal panel and the lower front corners of the box. This three-dimensional configuration of the image provides a perspective effect that gives the diorama a very realistic appearance, particularly when the image is adjusted in the manner described below to flow continuously between the panels with no physical seams between areas of the image displayed on adjacent ones of the panels. In that regard, it should be understood that the lines which appear on the image in FIG. 1 have been added to indicate the general areas in which the portions of the image displayed on the different panels flow together and are not actually part of, or visible in, the diorama.

The first step in making the diorama is selecting the image and converting it to digital form if it is not already in digital form. Then, using a photo manipulation program, features such as colors, contrast, and sharpness are adjusted as desired or required. The area to be the focal zone of the diorama is selected and, if necessary, adjusted for squareness and/or parallelism with the photo manipulation program. The size and position of the focal area, indicated by outline 51 in FIG. 2, relative to the edges of the image are then measured and recorded, and the image is recorded as a discrete file in the photo manipulation program.

The frame or container 22 is selected or constructed such that the image will be properly visible and is of a depth corresponding to the effect desired. The interior length, width, and depth of the frame or container are also measured and recorded.

Next, a guide for the flat layout of the diorama is constructed. This can be done either with a three-dimensional CAD (computer-aided design) program or by hand using orthographic projection techniques. First, a three-dimensional drawing of the shadow box or frame is prepared, as illustrated in FIG. 3, following which the outline 51 of focal area of the diorama is drawn in the desired position on the rear wall of the box.

A three-dimensional model of the upper, lower, and side panels of the diorama is constructed by drawing lines between the edges and corners of the background section and corresponding edges and corners of the frame or container, as also seen in FIG. 3. Thus, lines 41, 42 are drawn between the upper corners of the focal panel and the upper front corners of the box, and lines 43, 44 are drawn between the lower corners of the focal panel and the lower front corners of the box.

A flat, two dimensional layout guide is developed from the three-dimensional model of FIG. 3. Initially, as illustrated in FIG. 4, a two-dimensional projection of the model is drawn either manually or with software such as that utilized in the layout of sheet metal. In the two-dimensional representation, the edges of the panels which come together along lines 41-44 in the three-dimensional configuration are separated, as indicated by lines 41*a*-44*b*. These lines diverge outwardly from the corners of the focal panel at angles corresponding to the angles of panels 31-34 in the finished diorama.

Figure 5:
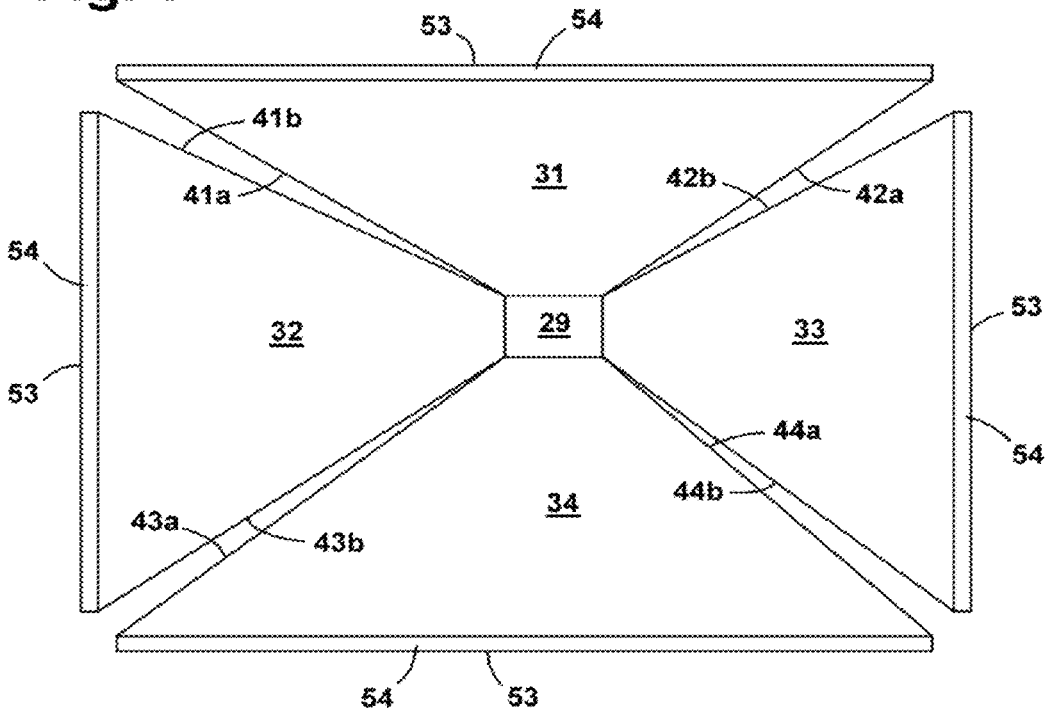
FIGS. 5-9 are plan views illustrating additional steps in the construction and use of the layout guide in creating a perspective adjusted two-dimensional image for use in the diorama in the embodiment of FIG. 1.

The two-dimensional projection of FIG. 4 is converted to an orthographic, or plan, view, as shown in FIG. 5, and guide lines 53 are added to the outer edges of the panels for use in constructing mounting tabs 54 which extend along the outer edges of panels 31-34 and are attached to the frame or box to hold the diorama in place.

The two-dimensional layout guide of FIG. 5 is then imported into the photo manipulation program. If the layout guide was generated with a CAD program, it is simply saved as a standard digital image file. If, however, the layout guide was drafted by hand, it is scanned electronically and then stored as a digital image file. In either case, the image of the layout guide is saved as a discrete file.

Using the layout guide as a template or guide, the two-dimensional photograph is converted into a three-dimensional diorama in which the image flows continuously between adjacent panels with no physical seams in the image between the panels. For this purpose, the photograph and the image of the layout guide are opened in the photo manipulation program, making sure they both have the same bit depth and pixel density. The canvas size of the photograph is checked to make sure it is large enough to allow all of the layout guide to be seen when it is imported into the photograph, and increased if necessary.

Figure 6:
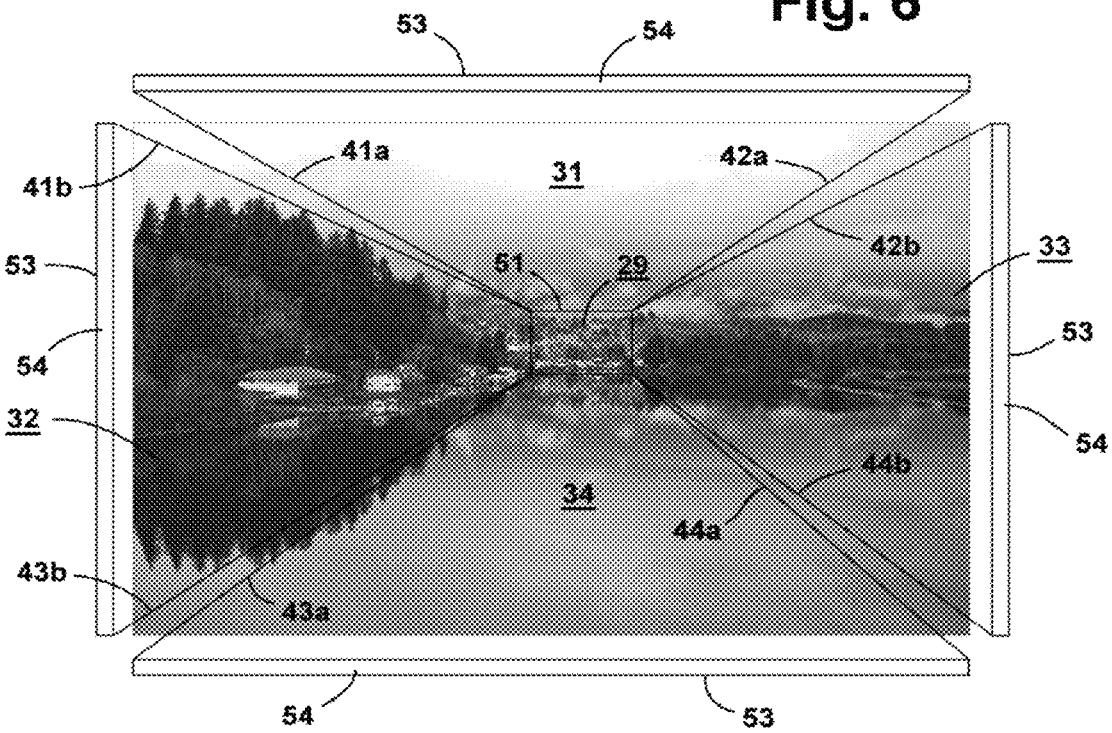

As illustrated in FIG. 6, the layout guide is superimposed onto the photograph and masked so that only the layout lines are visible. The positions of the two images are then adjusted so that the focal area of the photograph is aligned with the focal zone of the layout guide. At this point, none of the photographic image other then the focal area aligns with the layout guide, and the resolution of this incongruity is an important part of the invention. The precise selection and manipulation of each area of the image to fit the layout guide makes the image flow continuously between the panels and greatly enhances the three-dimensional perspective effect of the diorama.

Figure 7:
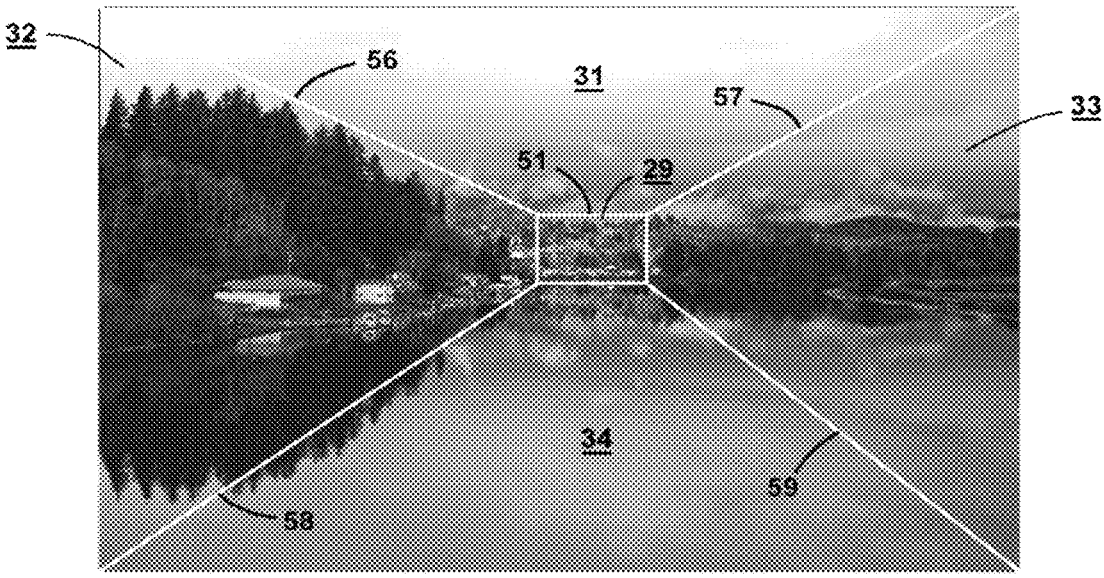

Using the editing tools of the photo manipulation program, the image is adjusted, one area at a time, to match the layout guide. As illustrated in FIG. 7, the precise sizes and shapes of the areas to be displayed on the panels are determined by drawing straight lines 56-59 from the corners of the focal area defined by to the corresponding outer corners of the original image, thereby establishing the precise outline of the area of the image to be displayed on each of the panels Although the diorama in this particular example has five panels, including the focal panel, the invention is not limited to this particular configuration, and different images may be more effectively presented with different numbers and arrangements of panels. Similarly, the focal zone can be of any desired size and/or shape, including one or more lines and/or points.

Figure 8:
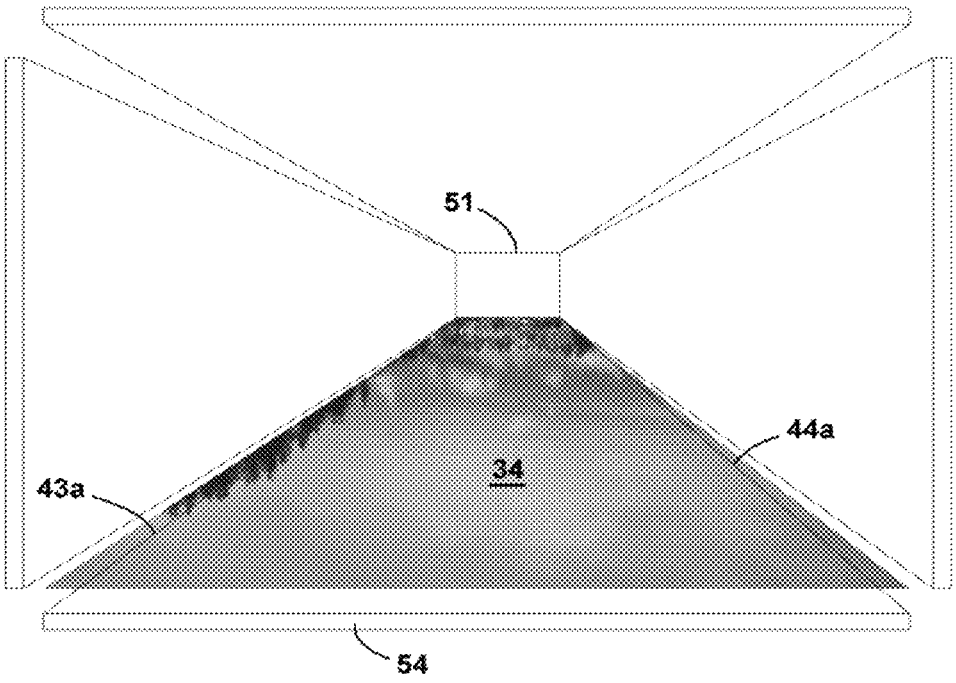
Figure 9:
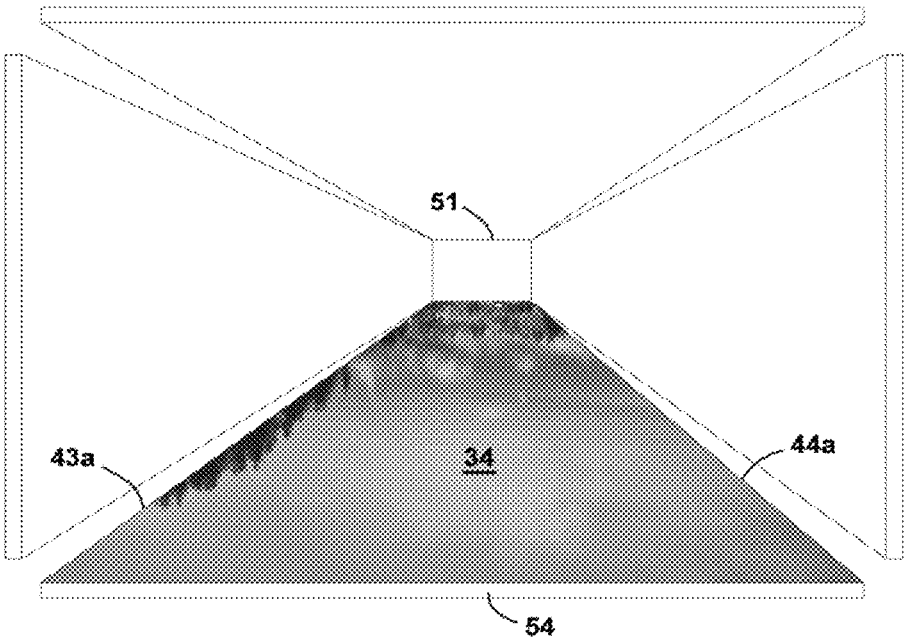
Figure 10:
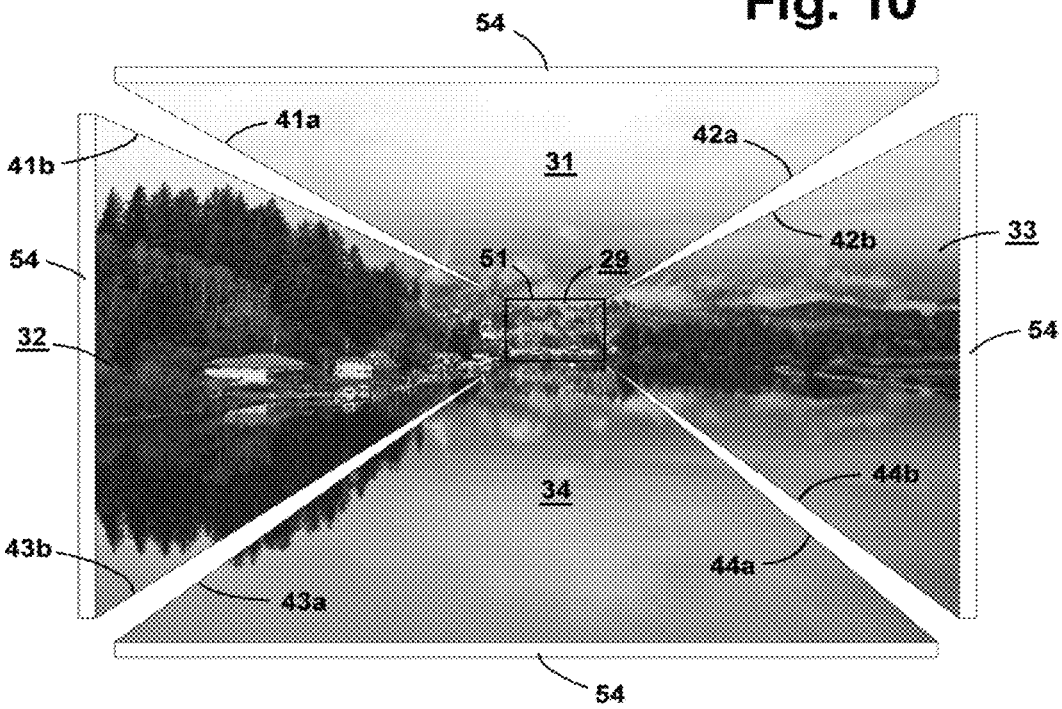
FIGS. 10-14 are plan views illustrating additional steps in creating the perspective adjusted image for use in the diorama in the embodiment of FIG. 1.

Using lower panel 34 as an example, the area of the image bounded by the lower edge of the focal panel, lines 58, 59, and the lower edge of the image is precisely selected with the photo manipulation software and duplicated. The original two-dimensional image is then turned off, leaving just the duplicate image of the lower area and the layout guide, as shown in FIG. 8. Using the transformation tools of the photo manipulation software, the size and shape of the duplicated image are adjusted as shown in FIG. 9 until the image corresponds precisely to the outline of the layout guide for the panel on which it is to be displayed. This procedure is repeated for each of the other areas of the image to be displayed on panels 31-33 so that the images for all four of the panels conform precisely to the layout guide, as shown in FIG. 10. Having been adjusted to conform to a two-dimensional projection of the panels of the diorama, the adjusted images are perspective projections of the corresponding areas of the two-dimensional image.

The focal area is then integrated into the adjusted image by turning off the adjusted images for the four outer panels, turning the original image on again, and precisely selecting the focal area bounded by outline 51. The focal area is expanded by one or two pixels, following which the original image is masked off except for the expanded focal area, and the adjusted images for the outer panels are turned on again.

Mounting tabs 54 are added to the adjusted image by copying them from the layout guide with the photo manipulation software and joining the copied images with the outer edges of the adjusted images for panels 31-34, as seen in FIG. 10.

The perspective enhanced two-dimensional image is now processed so that when it is printed on a two-dimensional medium, that printout can be formed into the three-dimensional contour of the diorama with the image flowing continuously between the panels of the diorama and no physical seams in the image between the panels. This is done by rotating the outer panels of the adjusted image about the focal panel from a seam line toward an anchor panel to separate the image at the seam line and bring facing edges of adjacent ones of the image panels together to form an image that extends continuously across the panels from one side of the seam line to the other, as illustrated in FIGS. 11-14.

Figure 11:
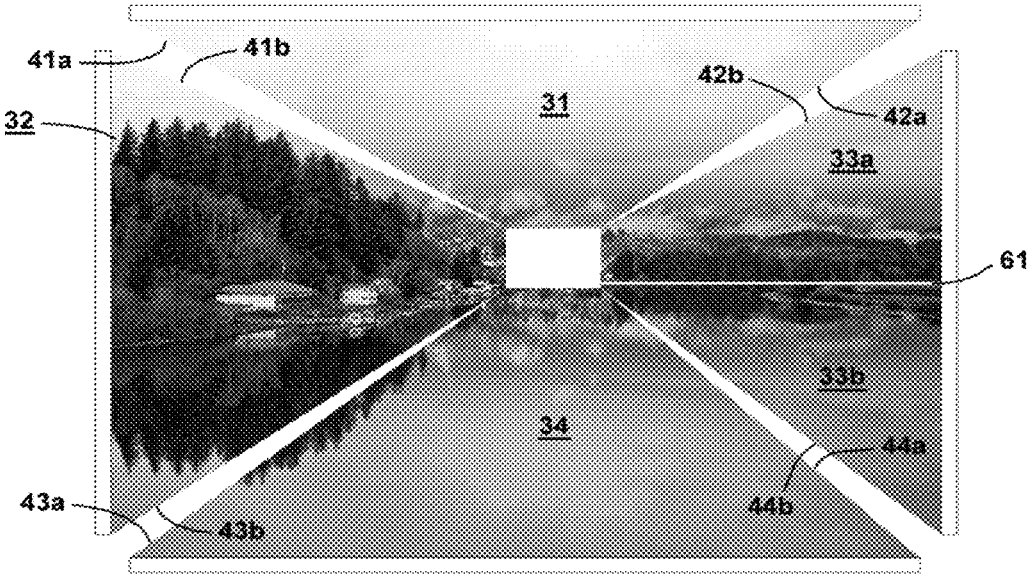

The seam line must extend from the focal zone to an outer edge of the image, and selection of the location for the seam line is of the utmost importance since the perspective illusion and the appearance of the diorama are enhanced by eliminating or concealing any seams in the image. With the image shown in this particular example, right side panel 33 is the best location for the seam because it has a natural horizontal line near the shore where the seam can be hidden. Thus, seam line 61 extends along the shoreline from the right side of focal panel 29 to the outer edge of the right side panel in the adjusted image, as seen in FIG. 11.

The anchor panel is fixed in place with the focal panel, and the other panels are rotated to join it. Generally, the largest panel or a panel opposite the seam line is chosen as the anchor panel, and in this particular example, left side panel 32 is chosen to be the anchor panel.

Seam line 61 divides the right side panel into an upper section 33*a* and a lower section 33*b*, and an image of the upper section is created by selecting that section and duplicating it with the photo manipulation software. The image thus created is then used to mask off the upper section of the original image and thereby create an image of the lower section that matches precisely with the image of the upper section.

The size of the canvas required to accommodate the rotated panels is estimated and, if necessary, the canvas is enlarged to the estimated size without enlarging the image. To keep the file size reasonable, the canvas should not be enlarged any more than necessary, although it can be trimmed, if desired, after the rotation process has been completed.

Figure 12:
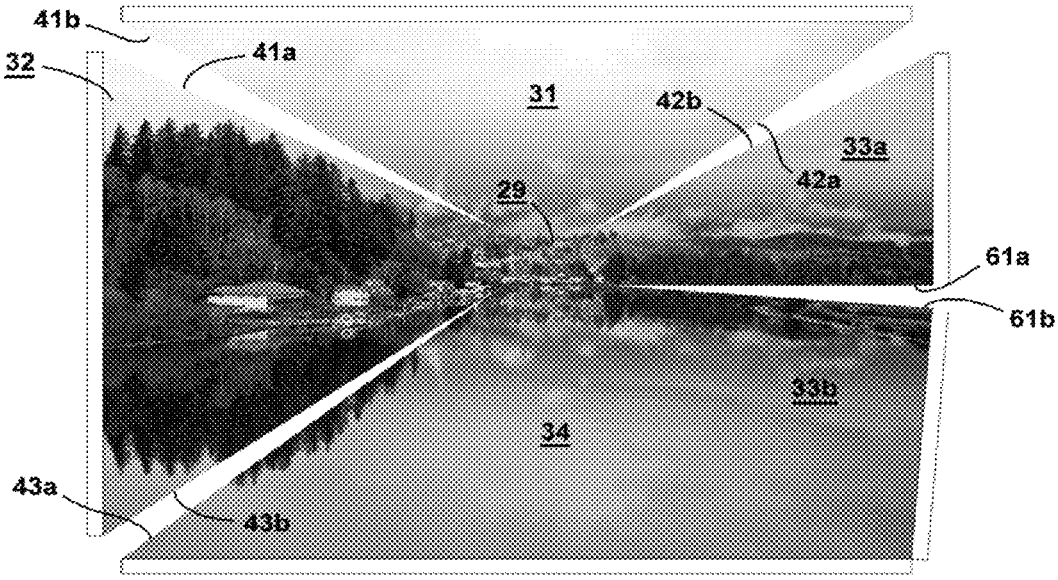

With canvas enlarged and the lower section 33*b* of right side panel 33 active, using the photo manipulation software, this section is rotated in a clockwise direction away from the seam line and toward the anchor panel to bring the lower edge 44*b* of the section into precise alignment with the right edge 44*a* of lower panel 34, with the image flowing continuously between the two panels, as seen in FIG. 12. In making the rotation, the center of rotation is preferably located at the intersection of the two edges, which greatly facilitates the ease and accuracy of the manipulation. The accuracy of the alignment is checked and verified by closely inspecting the alignment of features appearing in both panels.

Figure 13:
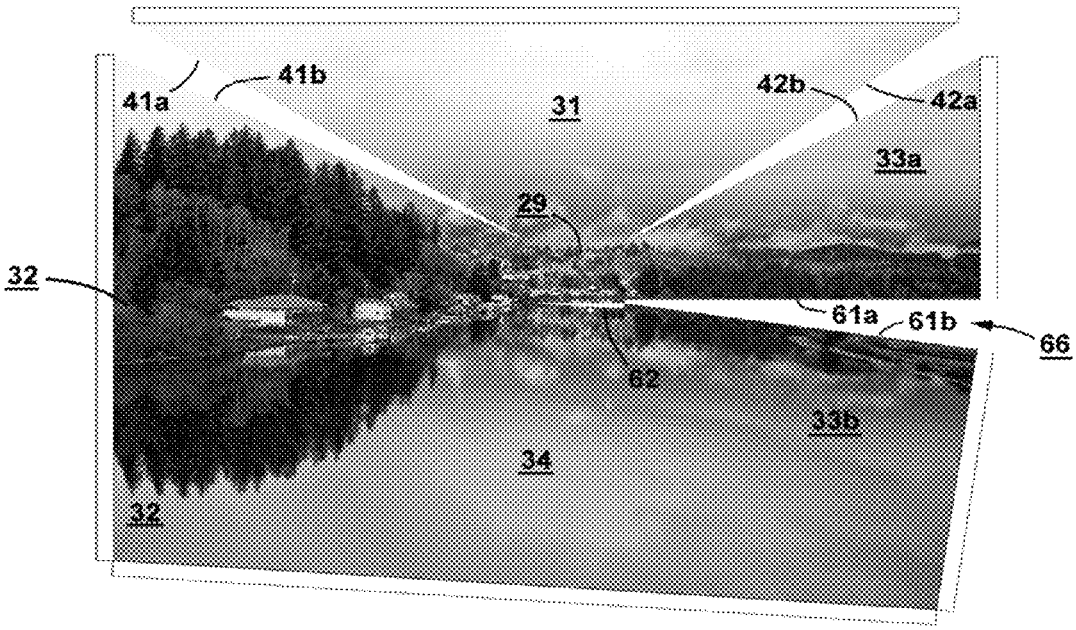

The rotated section is linked to the lower panel, and the center of rotation is moved to the intersection of the lower panel and the left side panel, i.e. the intersection of lines 43*a* and 43*b*. The linked panels are then rotated as a unit in the clockwise direction until the left edge 43*a* of lower panel 34 is in precise alignment with the lower edge 43*b* of anchor panel 32 and the image flowing continuously between the two panels, as shown in FIG. 13.

Figure 14:
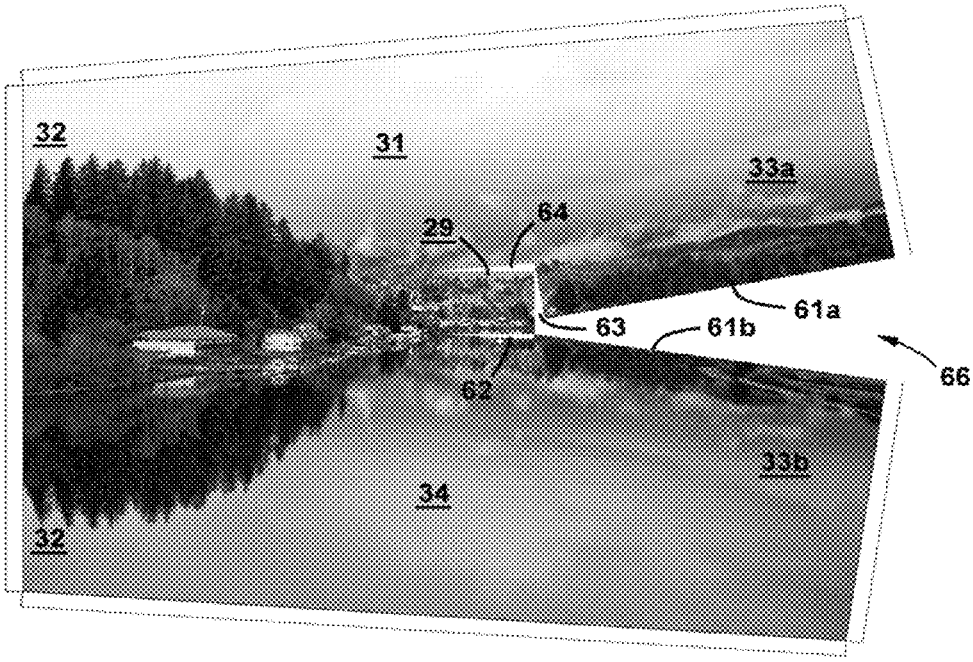

The process is repeated for the upper section 33*a* of right side panel 33 and upper panel 31 to bring the confronting edges of the panels together, with the image flowing continuously across the panels from one side of the seam line to the other, as seen in FIG. 14. Here, however, the panels are rotated in a counterclockwise direction since the panels on opposite sides of the seam line are rotated in opposite directions.

Since the outer panels of the image are not linked to the focal panel, they separate from it as they are rotated, just as the edges 61*a*, 61*b* of the upper and lower sections of panel 33 separate along the seam line as they are rotated away from it. This can be seen in FIG. 14 where gaps 62, 63, and 64 have opened up between the inner edges of panels 31, 33, and 34 and focal panel 29, and gap 66 has formed between the edges of panel sections 33*a*, 33*b*.

The rotated image is checked to verify that all of it is within the printable boundaries of the image. If necessary, the size of the canvas can be increased and/or excess can be cropped away so that the file and print size are no larger than needed. The fully transformed image is then saved as a distinct file.

If the process is precisely executed, resizing and distortion are very consistent between adjacent panels, and proofing should not be required. However, if an alignment problem does arise, it can be corrected by printing a full size copy of the flattened diorama, cut along the outline, and joining the edges along the seam line. The overall fit of the proof in the frame or container is checked, and the size of the image is adjusted if necessary. The areas where the image flows together between the panels are checked, and if any misalignments are noted, they are corrected by readjusting the images for the panels where the misalignment occurs. If proper alignment cannot be achieved, it may be necessary to remove or relocate one or more elements where the panels come together.

Figure 15:
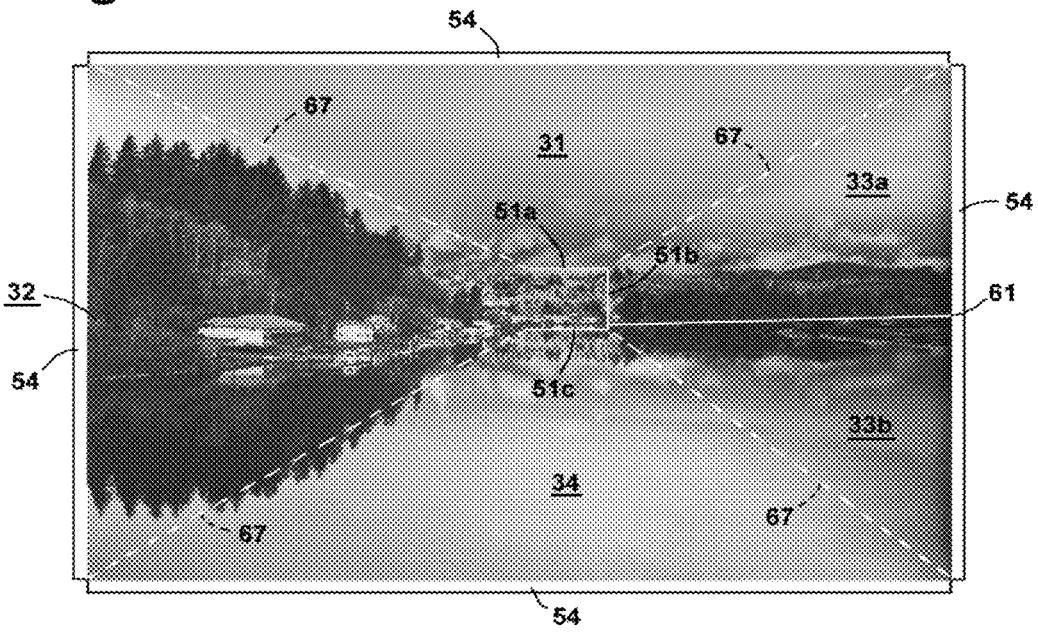
FIG. 15 is a front elevational view of the completed diorama in the embodiment of FIG. 1, with reference lines added to indicate corner areas between the panels and seams lines which permit the diorama to have its three-dimensional shape.
Figure 16:
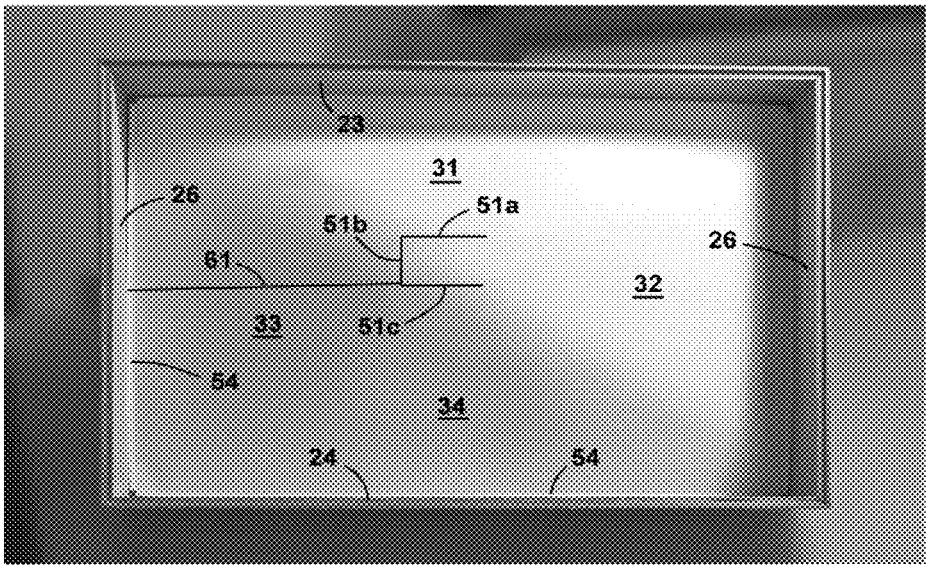
FIG. 16 is a rear view of the completed diorama in the embodiment of FIG. 1 mounted in a shadow box, with the rear wall of the box removed to expose the back side of the diorama.
Figure 17:
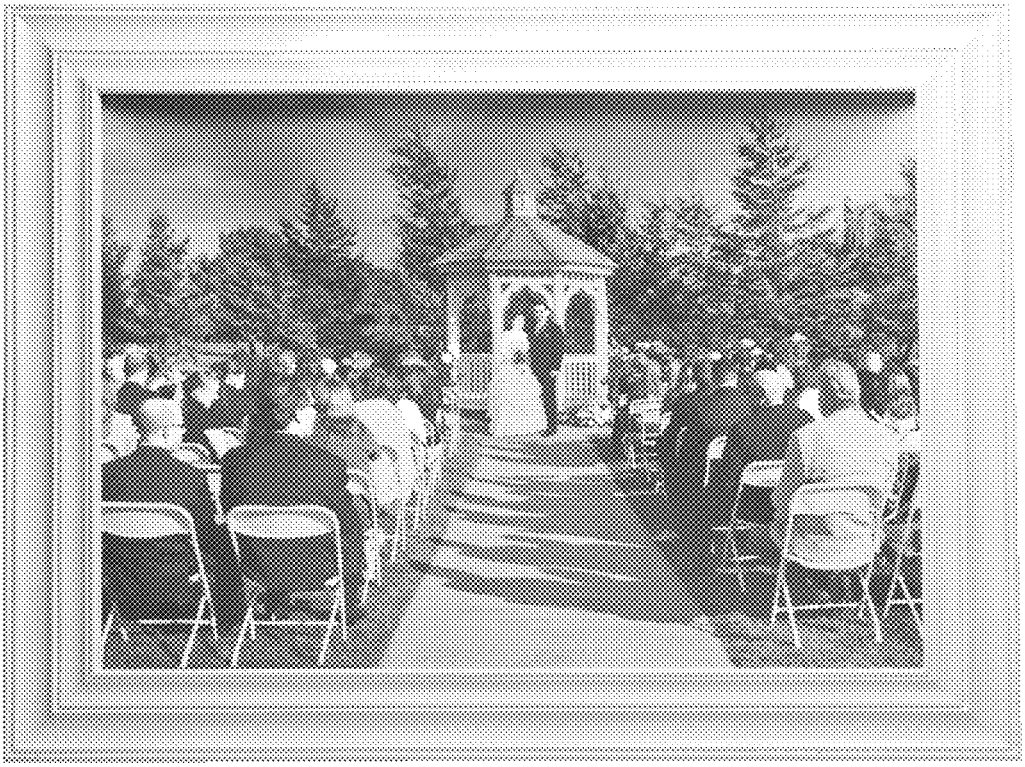
FIG. 17 is a front elevational view of another embodiment of a diorama according to the invention, mounted in a frame.

Once any necessary adjustments have been made, the final image of the flattened diorama is printed on photo paper, using printer settings that provide maximum clarity and impact. The flattened diorama is cut to the outline, then formed into its three-dimensional shape by bringing the separated edges 61*a*, 61*b* together along seam line 61 and along lines 51*a*-51*c* at the edges of the focal panel, as shown in FIGS. 15 and 16, then securing them by suitable means such as tape (not shown). The completed diorama is placed in the shadow box or frame, and the mounting tabs are attached to the box or frame to hold the diorama in place.

In forming the flattened diorama into its three-dimensional shape, it can be folded or creased along lines 67 which extend between the corners of the focus panel and the outer corners of the image. While such corner folds may enhance the three-dimensional or perspective effect with some images, it is generally preferable not to have the flow of the image interrupted by sharp corners, but instead to have the image flow continuously and smoothly through gentle curves between the panels. The smooth corners are particularly effective in images where the corners run across open water or sky, as in the present embodiment.

The layout described above, with a rectangular background or focal zone and a single main seam between one side of the background and one outer edge of the image, is particularly suitable for use where there the image includes a clearly defined flat plane such as a doorway, window, or person which appears as the focus of the image. Other images may be more effectively presented with a focal zone having a different shape and/or size and/or a different number of seams.

In the embodiment of FIGS. 17-24, the image once again has a rectangular background or focal area 28 and is displayed in a rectangular frame or box 22. Preparation of the layout guide is similar to that described above and includes the construction of a three-dimensional model of the diorama, as shown in FIG. 19, and conversion of the three-dimensional model to a two-dimensional guide that is superposed on the image, as illustrated in FIG. 20.

Figure 18:
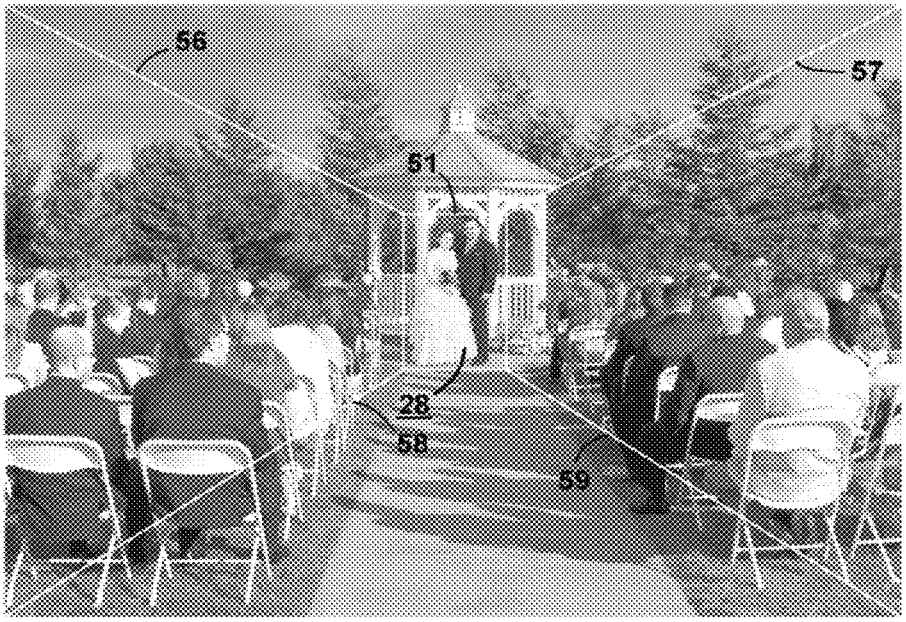
FIG. 18 a plan view of the original photograph displayed on the diorama in the embodiment of FIG. 17, with lines added to indicate the areas of the image to be displayed on the panels of the diorama.

Adjustment of the individual areas of the image to match the layout guide is likewise similar to that described above, with the precise sizes and shapes of the areas to be displayed on the panels of the diorama being determined by drawing straight lines 56-59 from the corners of the background or focal area to the corresponding outer corners of the original image, as shown in FIG. 18. Duplicate images of those areas are then made and carefully adjusted to fit the layout guide and displayed together to create the perspective adjusted image shown in FIG. 21.

Figure 21:
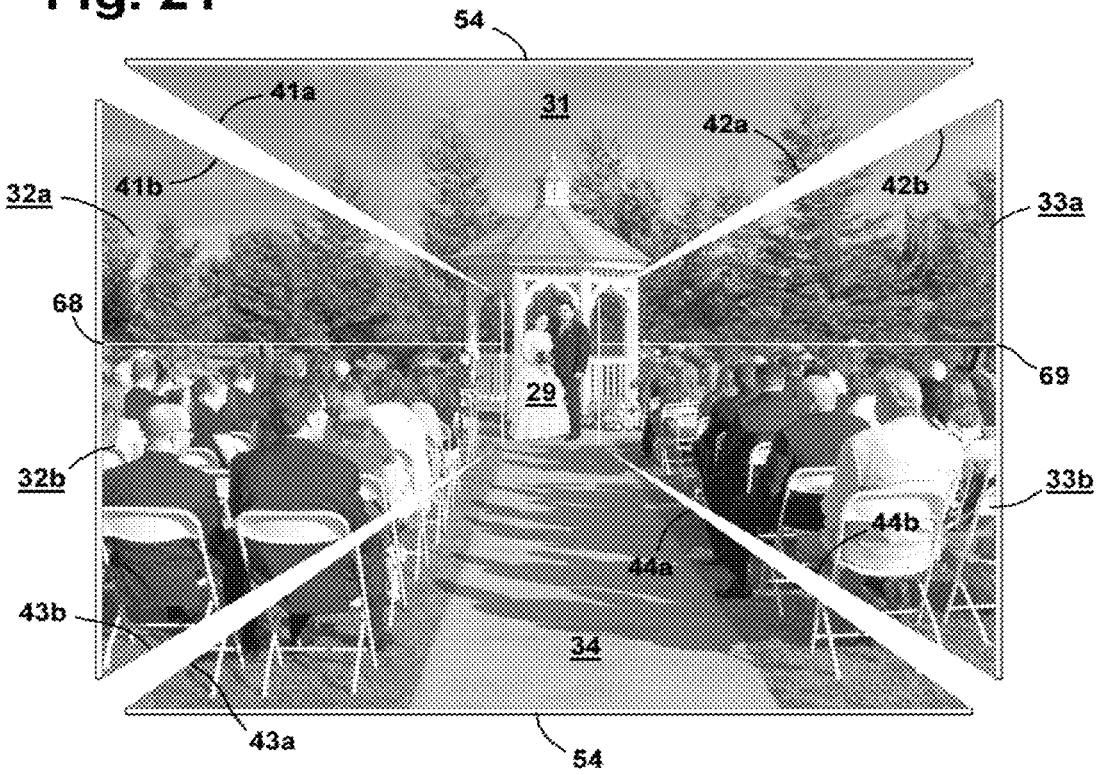
FIGS. 21 and 22 are plan views illustrating additional steps in creating the adjusted image for use in the diorama in the embodiment of FIG. 17.

This embodiment differs from the previous one in that it has seam lines on both sides of the background or focal area and two anchor panels. Thus, as illustrated in FIG. 21, seam lines 68, 69 extend from focal panel 29 across side panels 32, 33 to the outer edges of the adjusted image, with upper panel 31 and lower panel 34 both being anchor panels. Separate images 32*a*, 33*a* and 32*b*, 33*b* of the upper and lower sections of the side panels are created and integrated into the adjusted image in place of the images of the side panels, as seen in FIG. 21.

Figure 22:
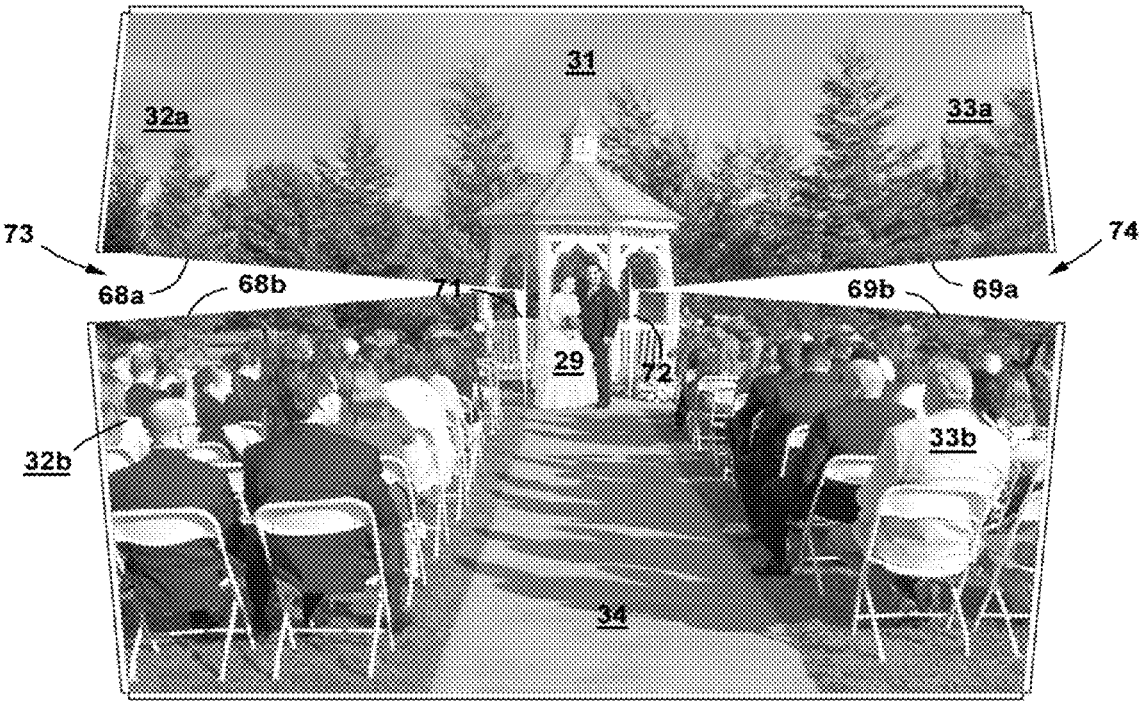

Upper sections 32*a*, 33*a* are rotated about focus panel 29 away from seam lines 68, 69 toward anchor panel 31 to bring the upper edges 41*b*, 42*b* into precise alignment with the side edges 41*a*, 42*b* of the anchor panel so that the image flows continuously between the panels, as shown in FIG. 22. Lower sections 32*b*, 33*b* are similarly rotated until edges 43*b*, 44*b* are in precise alignment with the side edges 43*a*, 44*a* of anchor panel 34 and the image flows continuously between those panels as well. As in the previous embodiment, the centers of rotation are preferably located at the intersections of the edges which are being brought together.

Since the sections of the side panel images are not linked to the image for the focus panel on either side, gaps 71, 72 open up between the side panel images and the lateral edges of the focus panel image, and gaps 73, 74 form between the upper and lower sections of the side panel images as those images are rotated away from seam lines 68, 69.

Figure 23:
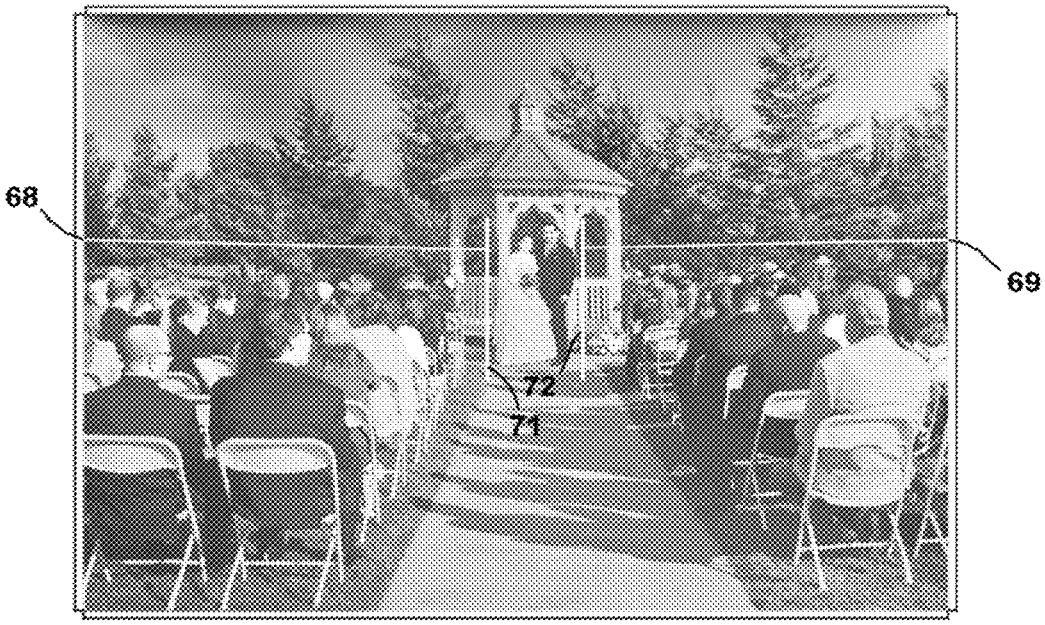
FIG. 23 is a front elevational view of the completed diorama in the embodiment of FIG. 17, with reference lines added to indicate the seams which permit the diorama to have its three-dimensional shape.
Figure 24:
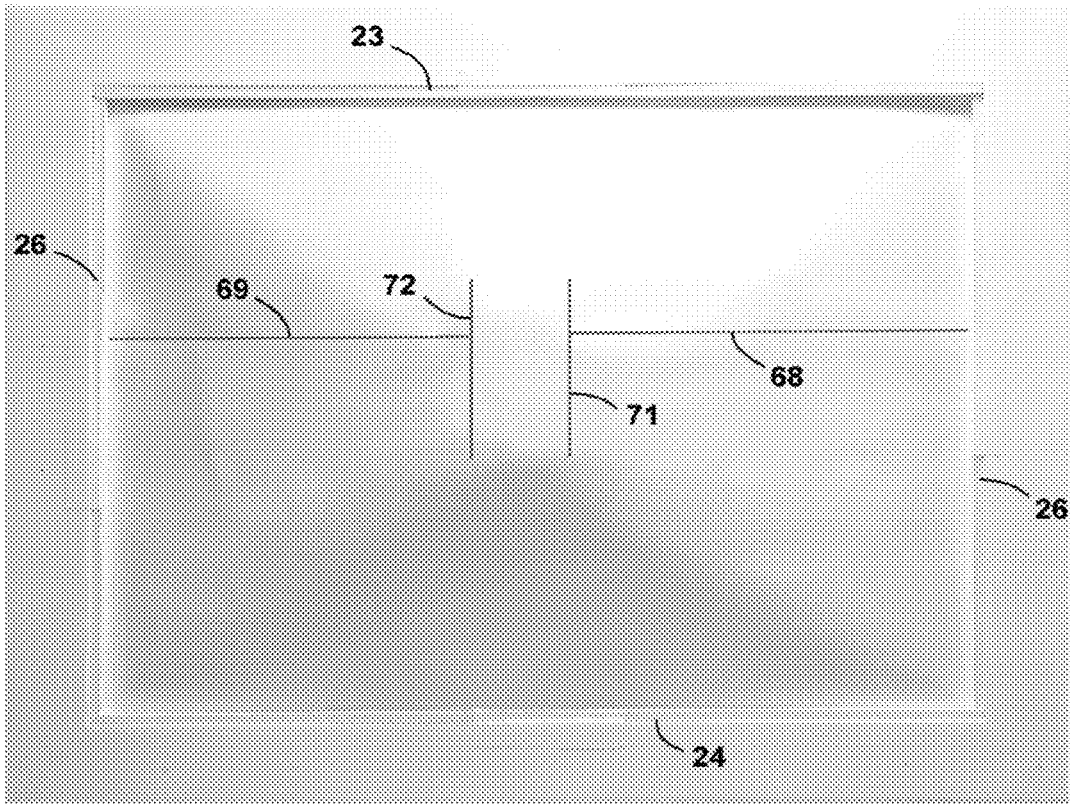
FIG. 24 is a rear elevational view of the embodiment of FIG. 17, with the rear wall of the shadow box removed to expose the back side of the diorama.
Figure 25:
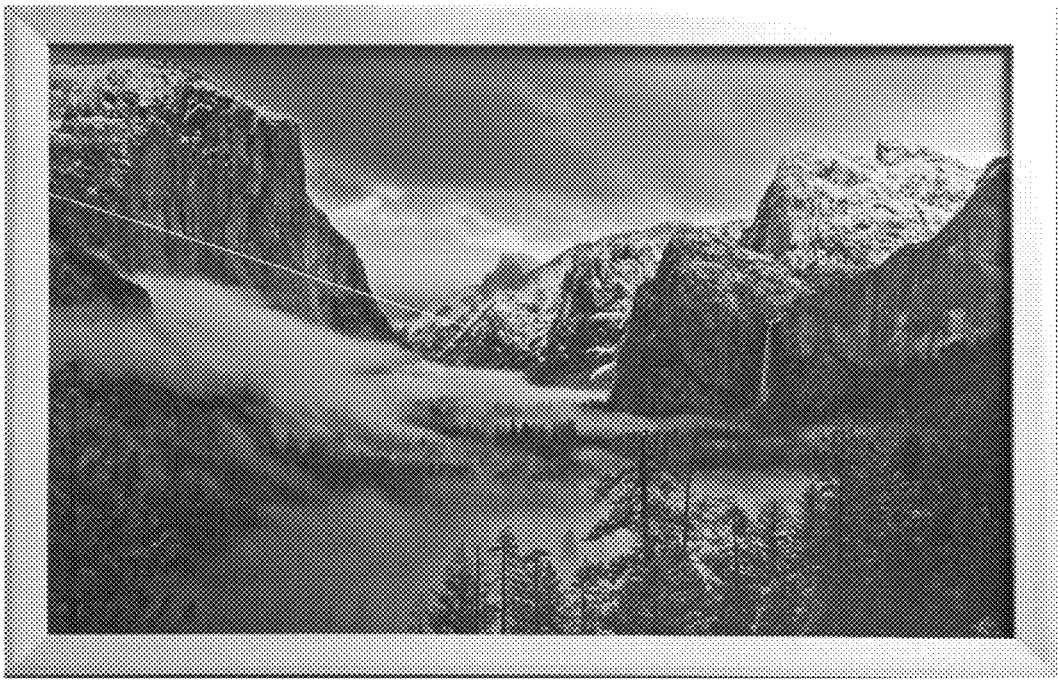
FIG. 25 is a front elevational view of another embodiment of a diorama according to the invention, mounted in a frame.

When the rotated image shown in FIG. 22 is printed, the flattened diorama is trimmed along the edges of all of the gaps, and the edges of the gaps are brought together to give the diorama its three-dimensional shape. Thus, as shown in FIGS. 23 and 24, the upper and lower edges 68*a*, 68*b* of sections 32*a*, 32*b* come together along seam line 68, the upper and lower edges 69*a*, 69*b* of sections 33*a*, 33*b* come together along seam line 69, and the side edges of sections come together with the side edges of focal panel 29 along lines 71, 72.

With the rectangular focal zone and two seam lines, this layout is particularly suitable for use with images having a clearly defined flat plane and clearly defined lines which, if used for the cut lines, would be naturally disguised. In the particular example illustrated, the image has vertically extending posts near the edges of the focal panel which help to conceal the secondary seams, or cut lines, 71, 72 where the edges of the side panel sections are brought together with the edges of the focal panel. On the upper and lower edges of the focal panel, where there are no cut lines or seams, there is a smooth transition between the focal panel and the two anchor panels.

In the embodiment of FIGS. 25-32, the focal zone or focus is a straight line 76, and the image is divided into four areas for display on the four panels 31-34 of the diorama in a rectangular frame or box 22. Preparation of the layout guide is similar to that described above and includes the construction of a three-dimensional model of the diorama, as shown in FIG. 27, and conversion of the three-dimensional model to a two-dimensional guide that is superposed on the image, as illustrated in FIG. 28.

Figure 26:
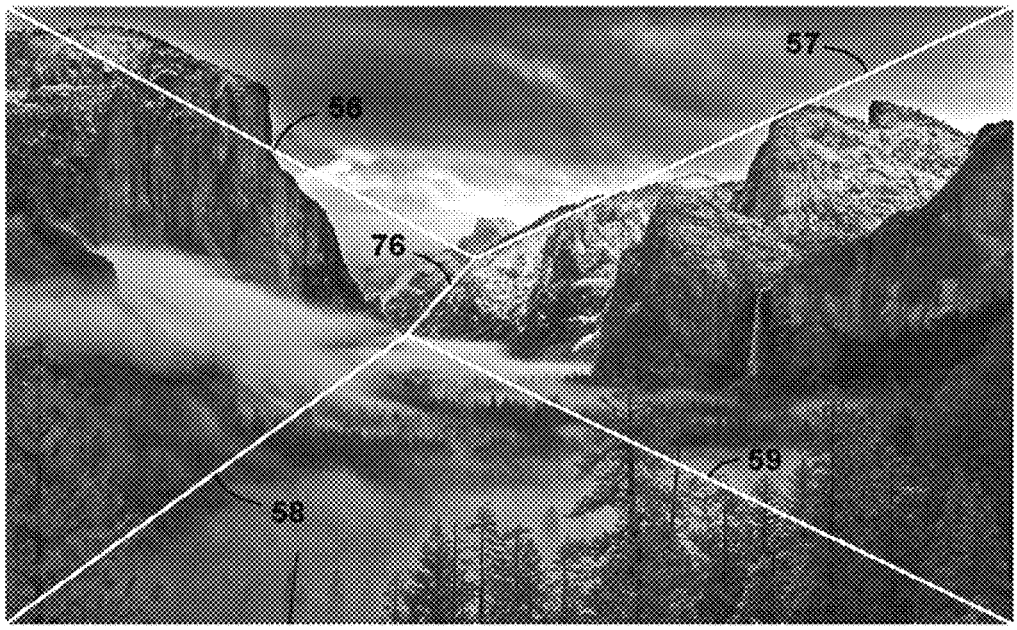
FIG. 26 a plan view of the original photograph displayed on the diorama in the embodiment of FIG. 25, with lines added to indicate the focal zone and the areas of the image to be displayed on the panels of the diorama.

Focal line 76 is aligned generally with the sloping edge of a granite outcropping in a central part of the image and is inclined at an angle on the order of 40 degrees to the vertical. This line is drawn on the rear wall of the shadow box, and corner lines 41-44 extend between the ends of the line and the corners of the box. The lines 56-59 which determine the size and shape of the areas of the image to be displayed on the panels are drawn between the ends of the focal line and the corners of the image, as seen in FIG. 26.

Figure 29:
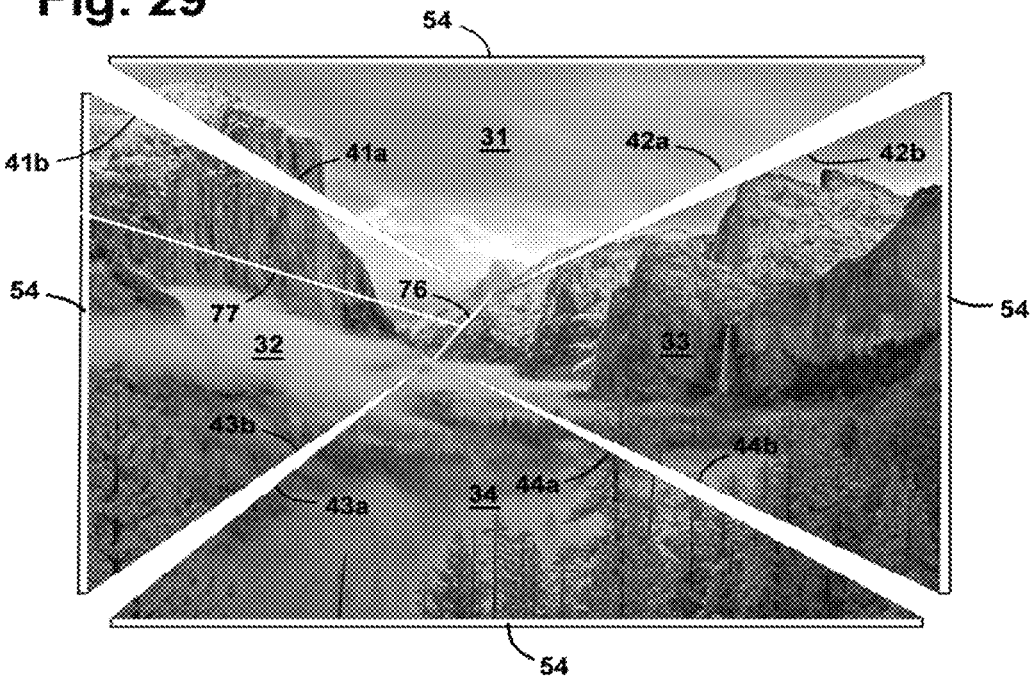
FIGS. 29 and 30 are plan views illustrating additional steps in creating the adjusted image for use in the diorama in the embodiment of FIG. 25.

As in the other embodiments, separate images of the areas bounded by lines 56-59 are created and carefully adjusted to fit the layout guide, then assembled together to form the adjusted image shown in FIG. 29.

In this embodiment, right side panel 33 is chosen as the anchor panel, and a single seam line 77 extends between focal line 76 and the outer edge of left side panel 32. Images of the upper and lower sections 32*a*, 32*b* of side panel 32 are created and integrated into the adjusted image in place of the image of the side panel.

Sections 32*a*, 32*b* are then rotated away from each other to bring edges 41*b* and 43*b* into precise alignment with the corresponding edges 41*a* and 43*a* of upper panel 31 and lower panel 34. Upper side panel section 32*a* and upper panel 31 are linked together, as are lower side panel section 32*b* and lower panel 34, following which the linked panels are rotated together to bring edges 42*a*, 44*a* of the upper and lower panels into precise alignment with the edges 42*b*, 44*b* of the right side, or anchor, panel 33. With the panels thus rotated, the image flows continuously across the panels from one side of seam line 77 to the other, as shown in FIG. 30.

Figure 30:
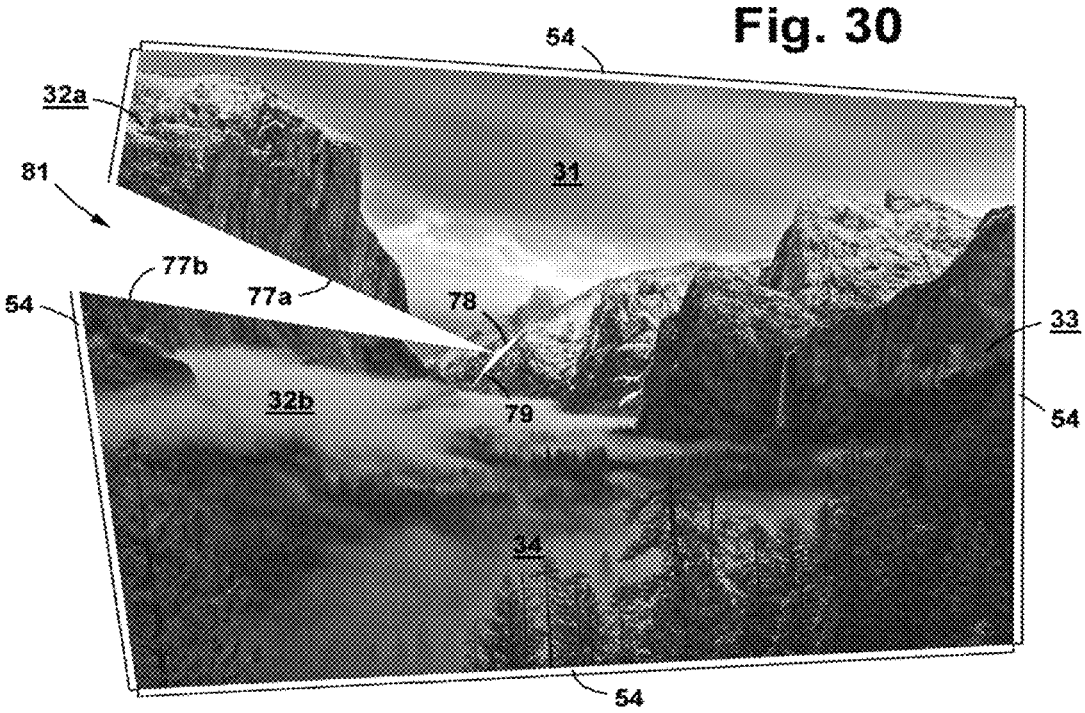

As the sections or panels of the image are rotated about the focal line, gaps 78, 79 and 81 open up along the focal line and between the edges of sections 32*a*, 32*b*, as can be seen in FIG. 30.

Figure 31:
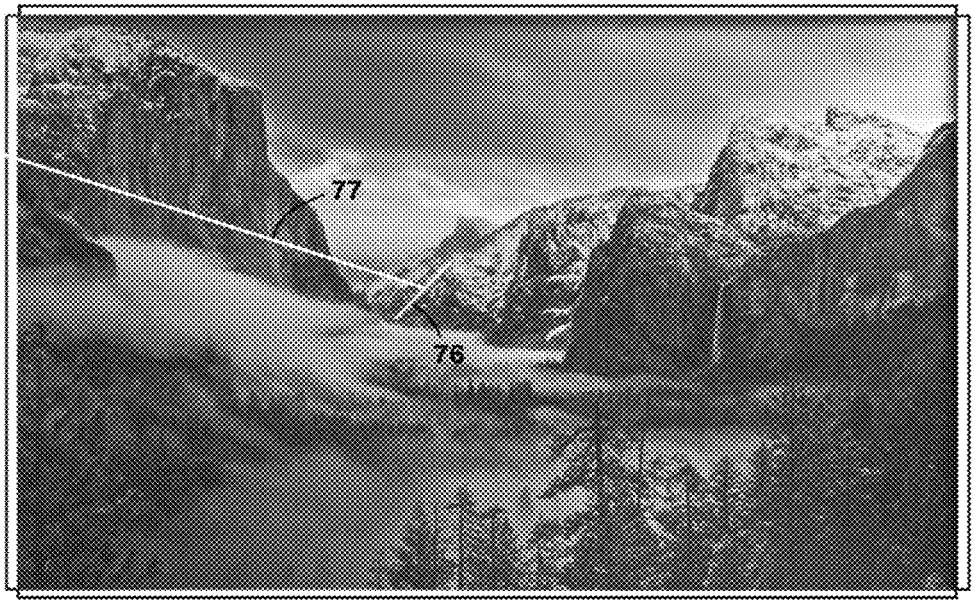
FIG. 31 is a front elevational view of the completed diorama in the embodiment of FIG. 25, with reference lines added to indicate the seams which permit the diorama to have its three-dimensional shape.
Figure 32:
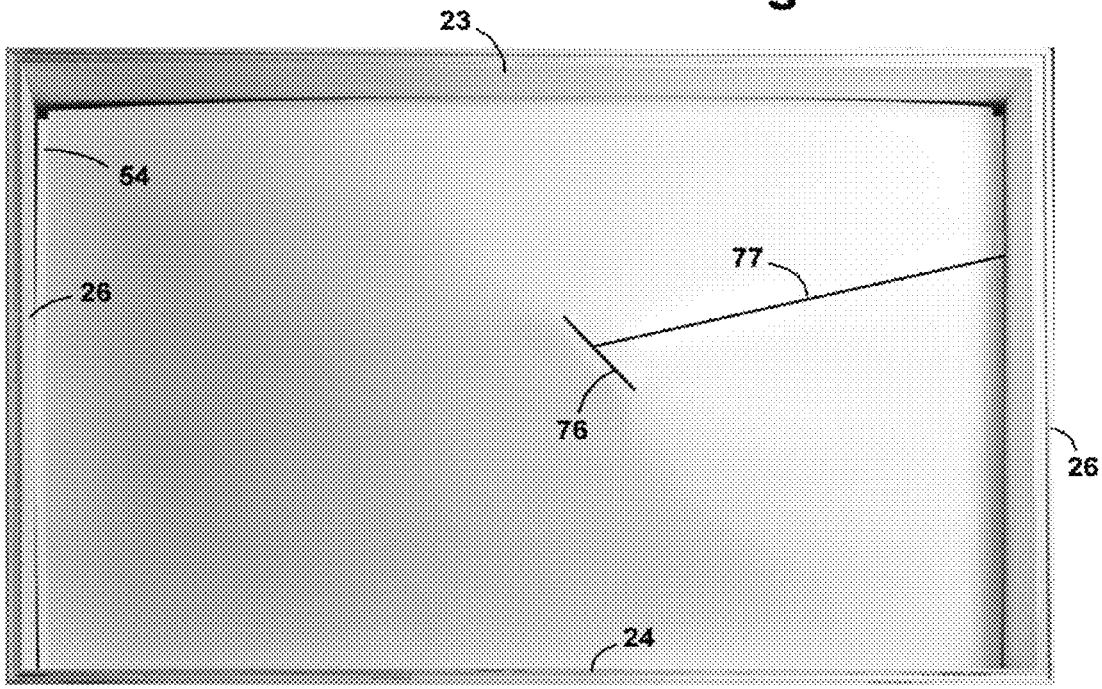
FIG. 32 is a rear elevational view of the embodiment of FIG. 25, with the rear wall of the shadow box removed to expose the back side of the diorama.

The rotated image is printed to produce a flattened diorama which is then trimmed along the edges of the gaps, and the trimmed edges are brought together to give the diorama its three-dimensional shape. Thus, as shown in FIGS. 31 and 32, the lower edge 71*a* of upper section 32*a* and the upper edge 71*b* of lower section 32*b* come together along seam line 71, and the side edges of the sections come together with the side edge of anchor panel 33 along focal line 76.

The layout with the single focal line works best for images having a natural line in which the focal line can be naturally concealed. The orientation of the focal line can be that which best suits the particular image, and it does not have to be a straight line.

Figure 35:
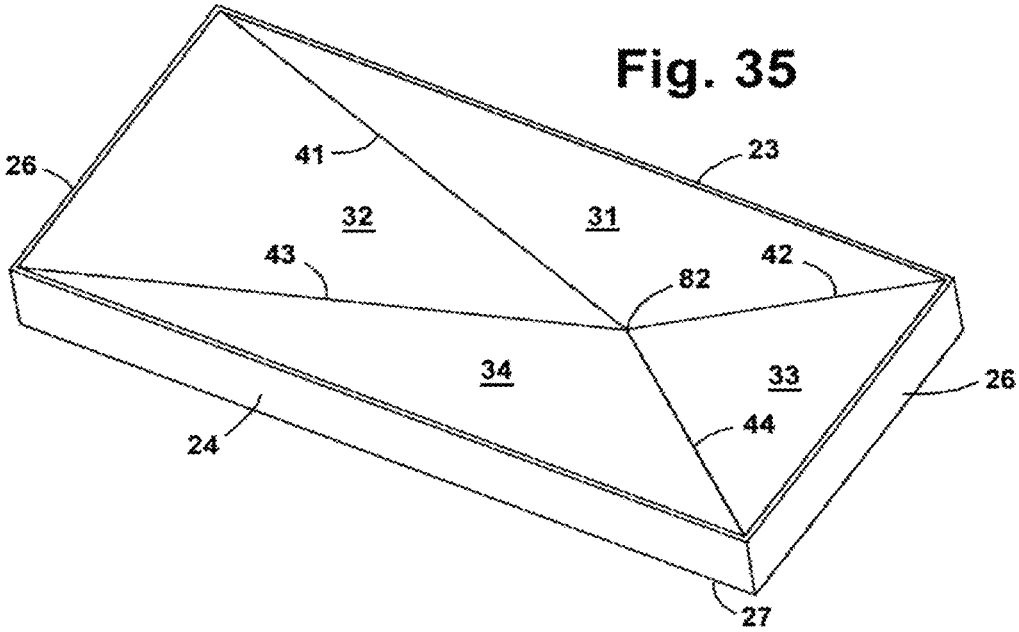
FIG. 35 is an isometric view of a three-dimensional model used in constructing a layout guide for use in a preferred method of making the diorama in the embodiment of FIG. 33.
Figure 36:
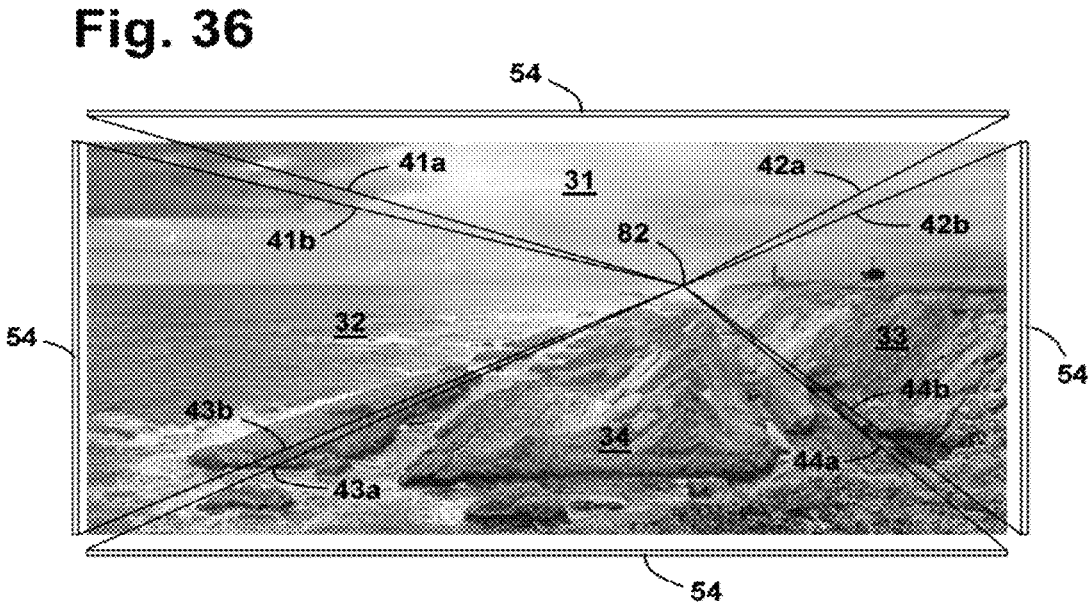
FIG. 36 is a plan view illustrating use of the layout guide in creating a perspective adjusted two-dimensional image for use in the diorama in the embodiment of FIG. 33.

In the embodiment of FIGS. 33-40, the focal zone or focus is a single point 82, and the image is once again divided into four areas for display on the four panels 31-34 of the diorama in a rectangular frame or box 22. Preparation of the layout guide is similar to that described above and includes the construction of a three-dimensional model of the diorama, as shown in FIG. 35, and conversion of the three-dimensional model to a two-dimensional guide that is superposed on the image, as illustrated in FIG. 36.

Focal point 82 is located on the rear wall of the shadow box, and corner lines 41-44 extend between that point and the corners of the box. The lines 56-59 which determine the size and shape of the areas of the image to be displayed on the panels are likewise drawn between the focal point and the corners of the image, as seen in FIG. 34.

Figure 37:
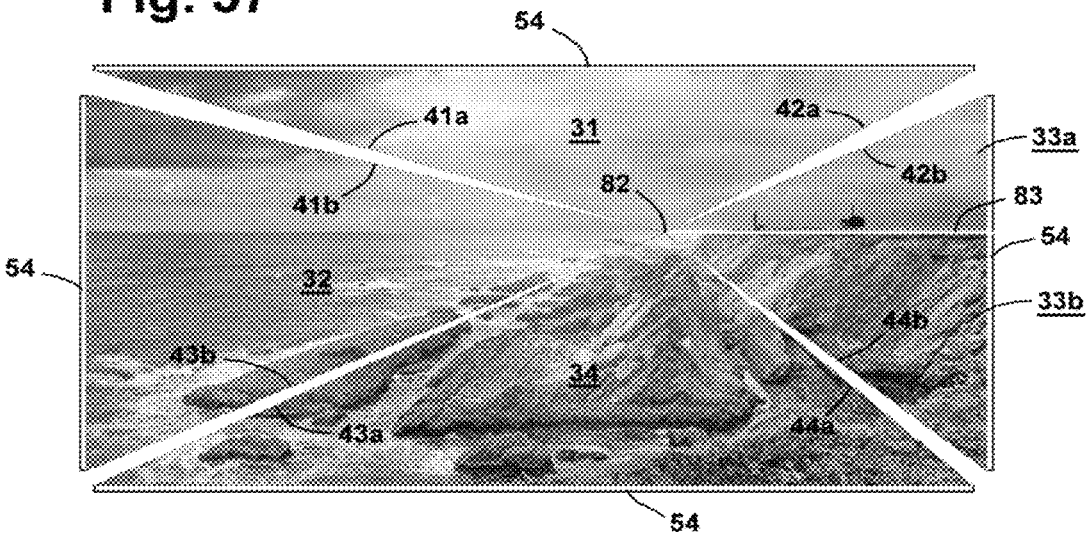
FIGS. 37 and 38 are plan views illustrating additional steps in creating the adjusted image for use in the diorama in the embodiment of FIG. 33.

As in the other embodiments, separate images of the areas bounded by lines 56-59 are created and carefully adjusted to fit the layout guide, then assembled together to form the adjusted image shown in FIG. 37.

In this embodiment, left side panel 32 is the anchor panel, and a single seam line 83 extends between focal point 82 and the outer edge of right side panel 33, with the seam line following a horizon line it can be concealed. With the seam line established, images of the upper and lower sections 33*a*, 33*b* of side panel 33 are created and integrated into the adjusted image in place of the image of side panel 33.

Sections 33*a*, 33*b* are then rotated away from each other to bring edges 42*b* and 44*b* into precise alignment with the corresponding edges 42*a* and 44*a* of upper panel 31 and lower panel 34. Upper side panel section 33*a* and upper panel 31 are linked together, as are lower side panel section 33*b* and lower panel 34, following which the linked panels are rotated together to bring edges 41*a*, 43*a* of the upper and lower panels into precise alignment with the edges 41*b*, 43*b* of the left side, or anchor, panel 32. With the panels thus rotated, the image flows continuously across the panels from one side of seam line 83 to the other, as shown in FIG. 38.

Figure 38:
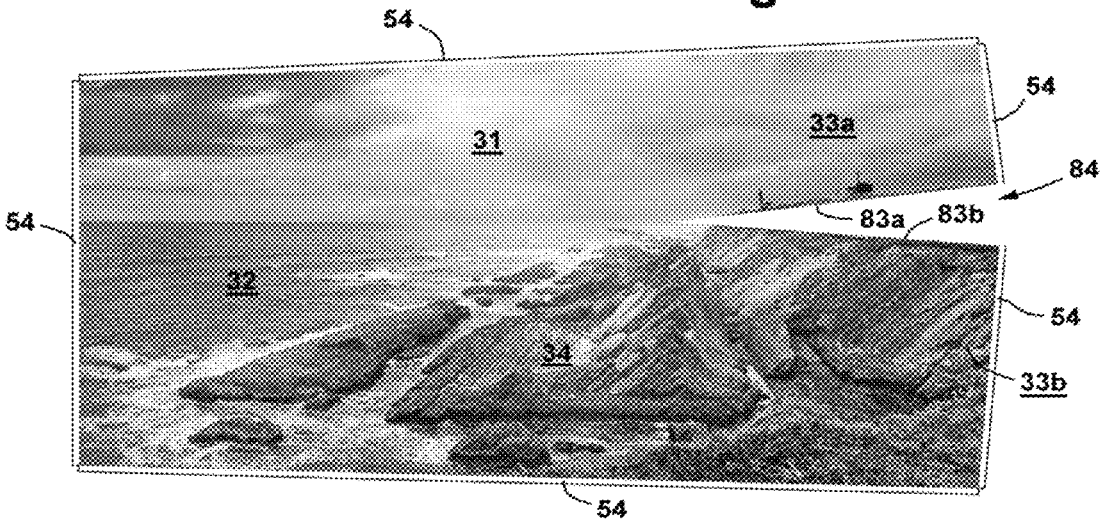

As the sections or panels of the image are rotated about the focal point, a gap 84 opens between the lower edge 83*a* of upper section 33*a* and the upper edge 83*b* of lower section 33*b*, as can be seen in FIG. 38. With the centers of rotation all being at the focal point, there is no separation between the panels and the focal zone, and gap 84 is the only gap created by the rotation.

Figure 39:
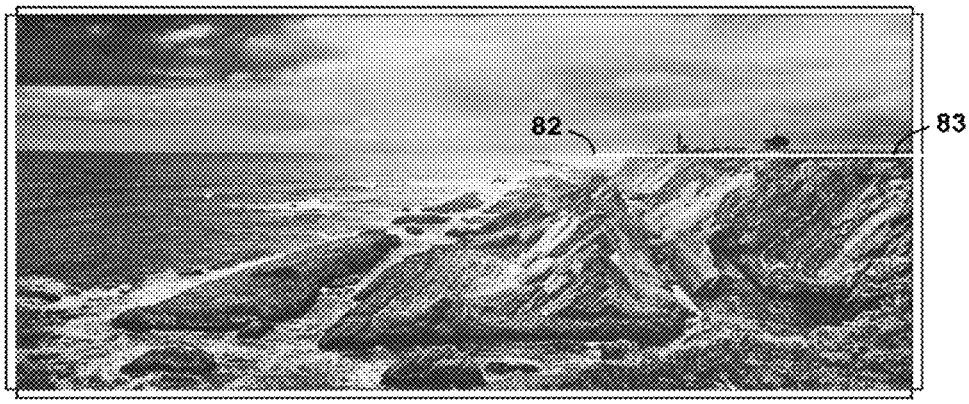
FIG. 39 is a front elevational view of the completed diorama in the embodiment of FIG. 33, with a reference line added to indicate the seam which permit the diorama to have its three-dimensional shape.
Figure 40:
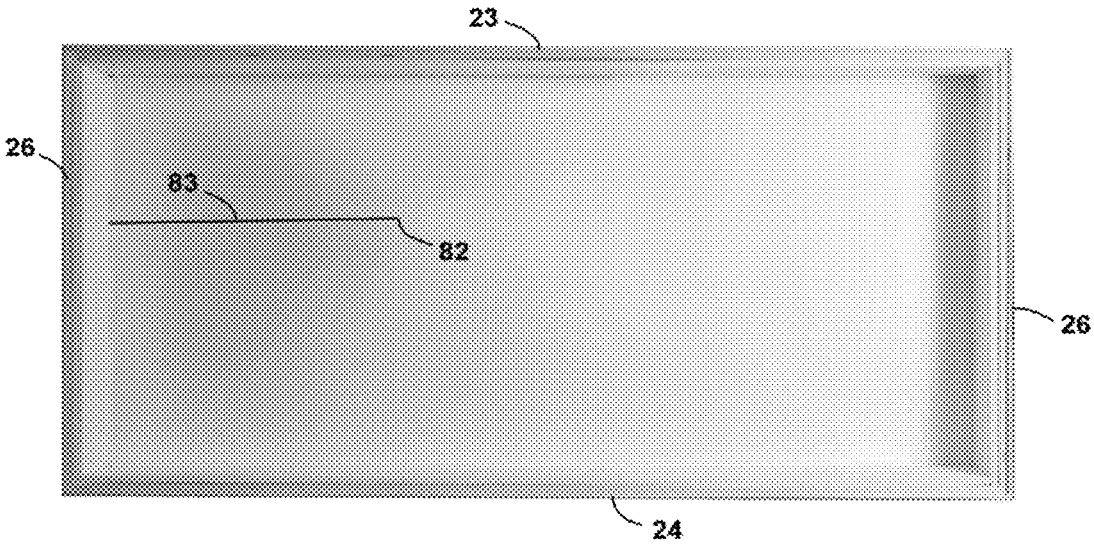
FIG. 40 is a rear view of the embodiment of FIG. 33, with the rear wall of the shadow box removed to expose the back side of the diorama.
Figure 41:
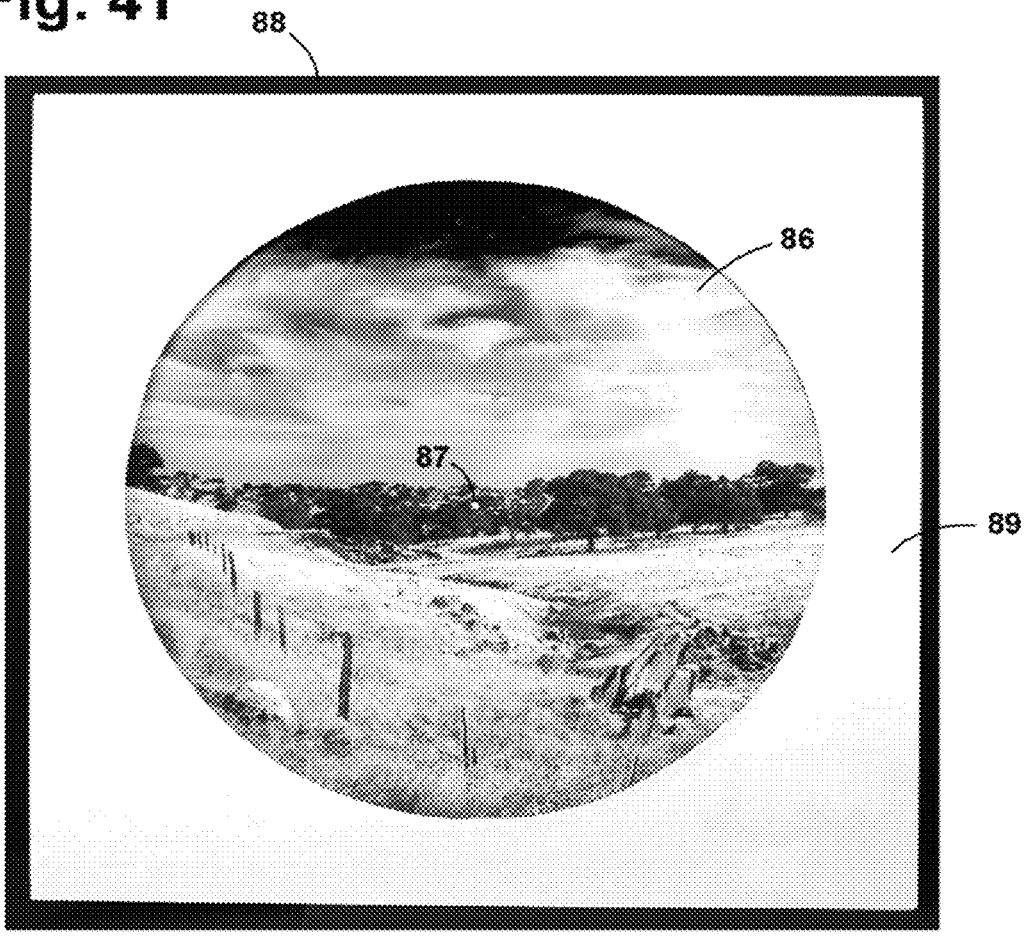
FIG. 41 is a front elevational view of another embodiment of a diorama according to the invention, mounted in a frame with a mat.

The rotated image is printed to produce a flattened diorama which is then trimmed along the edges of the gap, and the trimmed edges are brought together to give the diorama its three-dimensional shape. Thus, as shown in FIGS. 39 and 40, the lower edge 83*a* of upper section 33*a* and the upper edge 83*b* of lower section 33*b* come together along seam line 83.

The layout with the single focal point line is best for use with images in which the perspective focus appears to be a great distance away or is clearly defined by the image as a single focal point.

In the embodiment of FIGS. 41-59, the diorama 86 is circular, and the focal zone or focus is a single point 87 located at the center of the image. Although the diorama is shown as being mounted in a rectangular frame 88 with a rectangular mat 89, the diorama itself is circular. In this particular embodiment, the image is mounted in behind an opening in the mat, but it is nevertheless laid out as though it were going to be mounted a circular box 91. The box has a flat circular rear wall 92, a cylindrical side wall 93, an open front, and a diameter to depth ratio on the order of 4:1 for the particular image.

Figure 42:
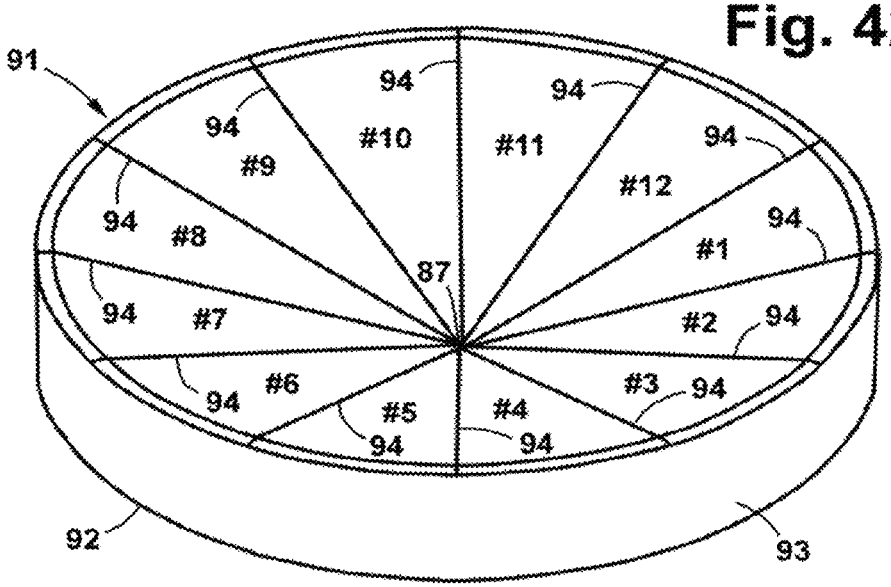
FIG. 42 is an isometric view of a three-dimensional model used in constructing a layout guide for use in a preferred method of making the diorama in the embodiment of FIG. 41.

In constructing the three-dimensional model for the layout guide, focal point 87 is positioned at the center of rear wall 92, and lines 94 are drawn between the focal point—and the front edge of side wall 93 to define the panels of the diorama, as illustrated in FIG. 42. The number of panels should be large enough to provide smooth transitions between the panels for the image displayed thereon, and in this particular example, twelve panels, designated #1-#12, are spaced equally about the focal point. This number of panels was chosen for ease of illustration, and in practice an image of this type would probably be divided into 24 or 36 panels in order to provide smoother transitions.

Figure 43:
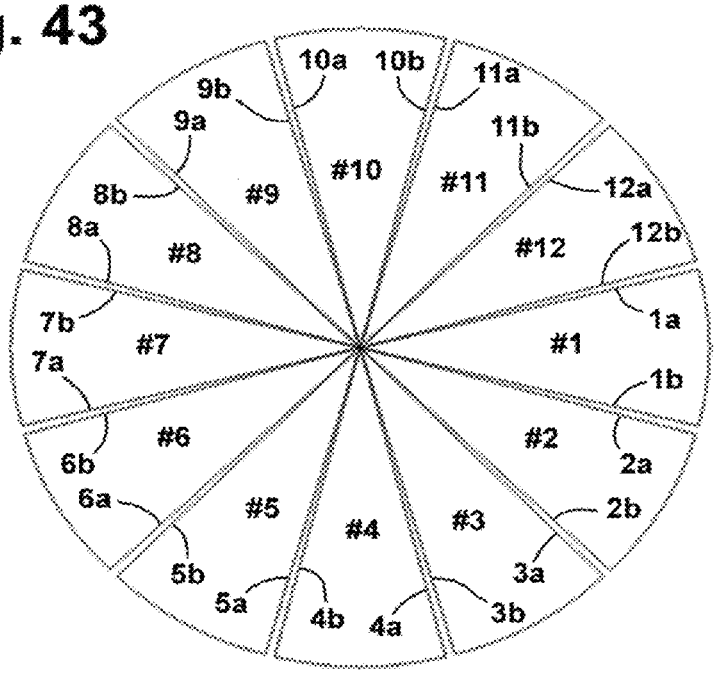
FIGS. 43-46 are plan views illustrating additional steps in the construction and use of the layout guide in creating a perspective adjusted two-dimensional image for use in the diorama in the embodiment of FIG. 41.
Figure 44:
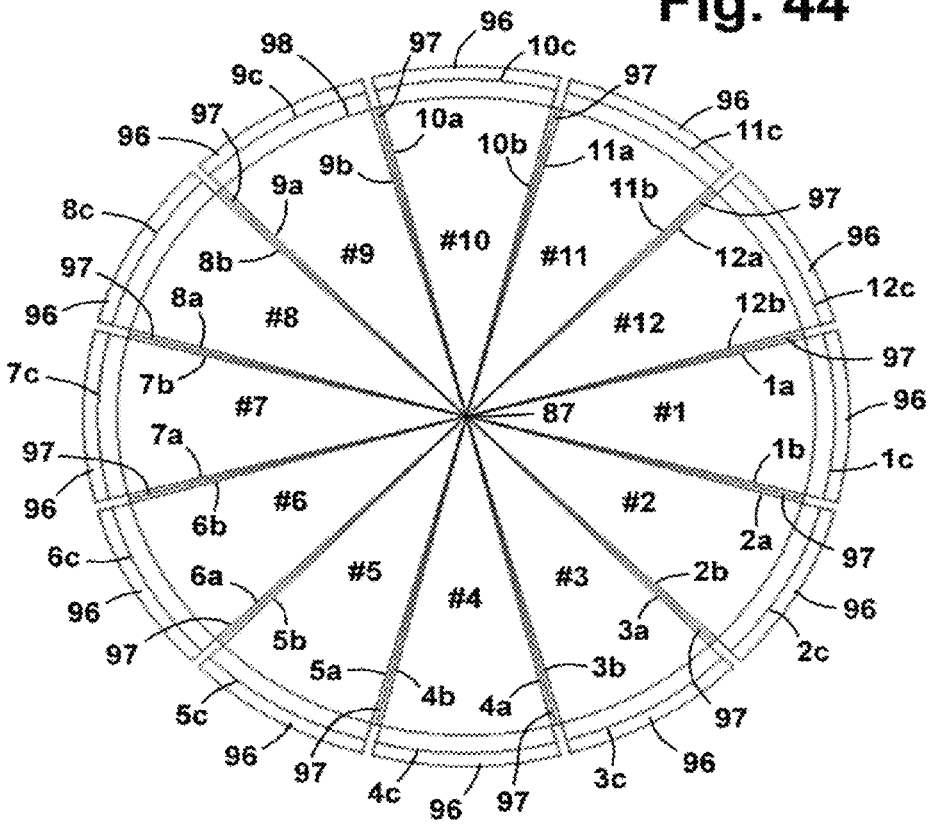

In the two-dimensional projection of the model, diverging lines 1*a*, 1*b*-12*a*, 12*b* extend outwardly from the focal point and define the side edges of the sector-shaped panels of the diorama, as shown in FIG. 43. Mounting tabs 96 and guide lines 97 are added to the projection, as shown in FIG. 44. Lines 97 bisect the angles between the panels and extend between the focal point and a circle 98 centered at the focal point. This circle has a diameter equal to that of the image to be displayed and, together with lines 97, define the area of the image for each panel. This layout guide thus has one set of lines for selecting the areas of the image to be displayed and another for adjusting the selected areas to fit the panels of the diorama.

Figure 45:
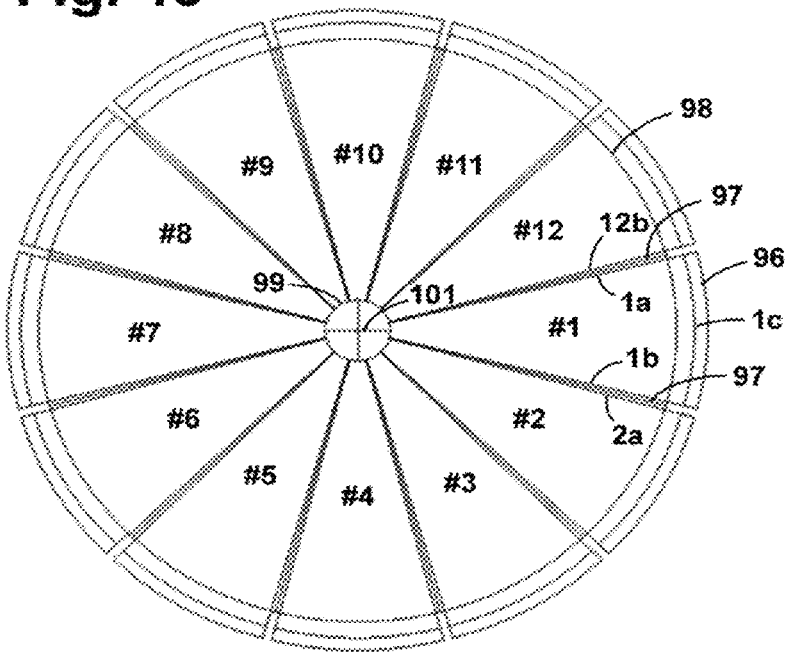

To aid in precise selection of the segments to displayed, a small, centered circle 99 is added to the layout guide. All of the intersecting lines within this circle are erased and replaced by a single point or crosshairs 101 at the center of the guide, as shown in FIG. 45.

The guide is masked so that only the layout lines and the tabs are visible, and stored as a discrete image file.

Figure 46:
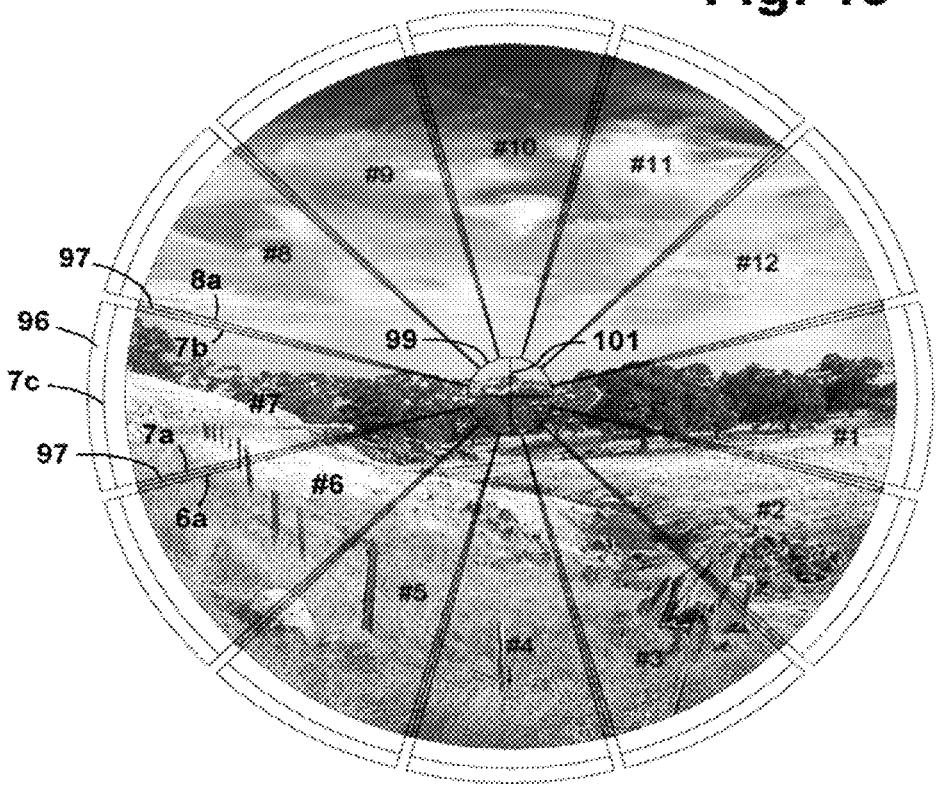

The layout guide is superimposed on the image to be displayed, as shown in FIG. 46, with the crosshairs aligned with the focal point of the image. Here, it will be noted that the image to be displayed is of lesser diameter than the projected image of the diorama and that the sections of the image are wider than the panels of the diorama. As in the other embodiments, the areas of the image to be displayed are carefully selected and adjusted to fit precisely on the panels so that the image will flow continuously and seamlessly between them.

Figure 47:
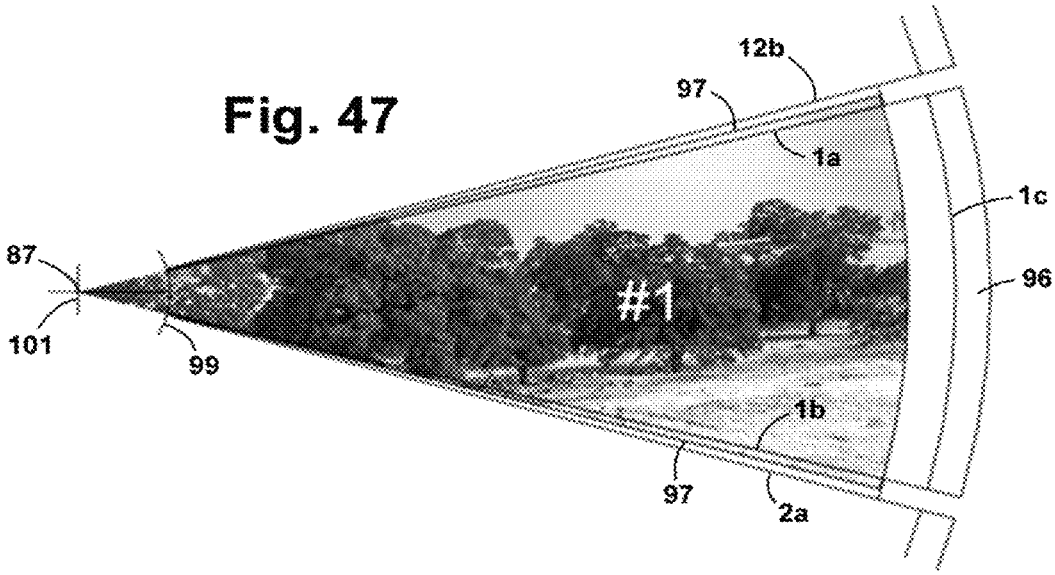
FIGS. 47 and 48 are enlarged, fragmentary, plan views illustrating additional steps in the use of the layout guide in creating the perspective adjusted two-dimensional image for use in the diorama in the embodiment of FIG. 41.
Figure 48:
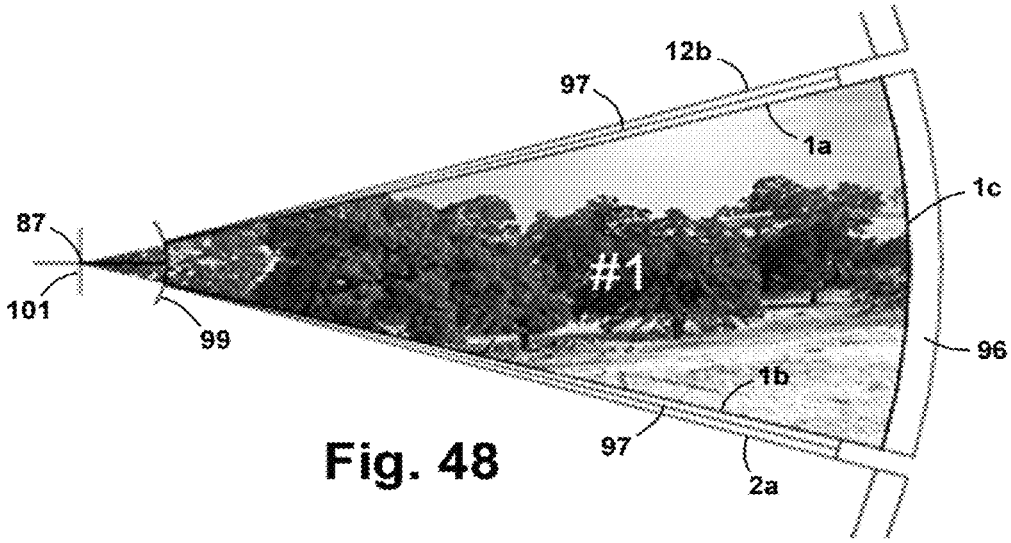

Adjustment of the image to fit the diorama is illustrated in FIGS. 47 and 48, using panel #1 as an example. Using the photo manipulation software, the area of the image to be displayed on the panel is precisely selected extending the selection from the focal point out to the edge of the original image to the point where the bisecting line 97 between the upper edge 1*a* of panel #1 and the lower edge 12*b* of panel #12 intersects the edge, then proceeding carefully just outside the arc of the original image to the point where that arc intersects the bisecting line 97 between the lower edge 1*b* of panel #1 and the upper edge 2*a* of panel #2, then following that line back to the focal point or center.

The selected area is duplicated, and the original two-dimensional image is turned off, leaving just the duplicate image of the selected area and the layout guide, as shown in FIG. 47. Using the transformation tools of the photo manipulation software, the size and shape of the duplicated image are adjusted until the image corresponds precisely to the outline of the panel on layout guide as defined by lines 1*a*, 1*b* and the arc 1*c* at the outer edge of the panel. The mounting tab 96 is added to the panel by duplicating an area slightly larger than the mounting tab on the layout guide and merging that selected area with the adjusted image for the panel. The process is repeated for each of the other areas of the image so that the images for all twelve of the panels conform precisely to the layout guide.

Figure 49:
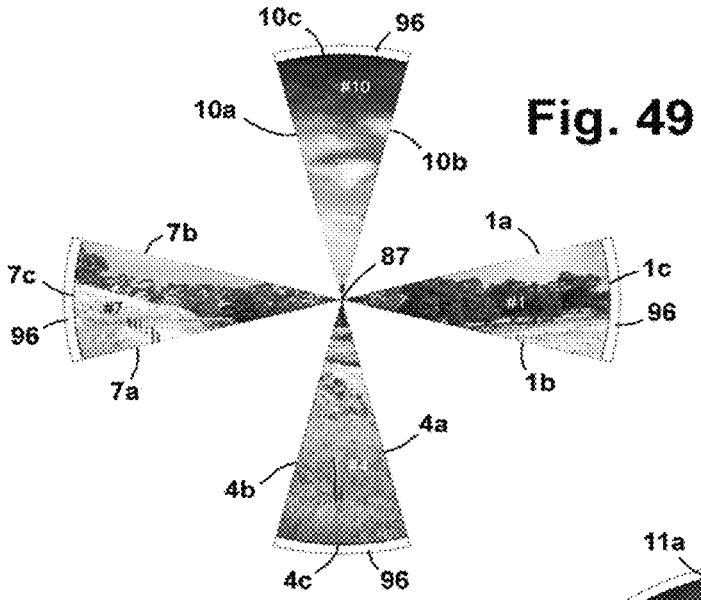
FIGS. 49-51 are plan views illustrating additional steps in creating the perspective adjusted image for use in the diorama in the embodiment of FIG. 41.
Figure 50:
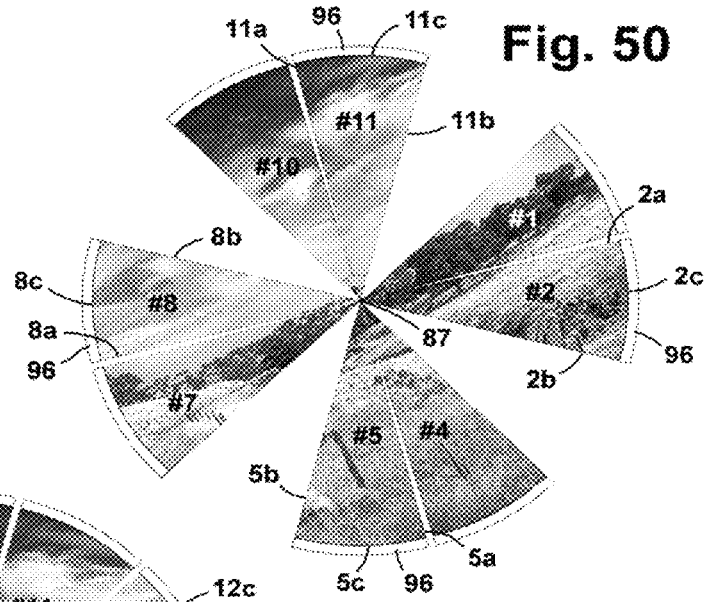
Figure 51:
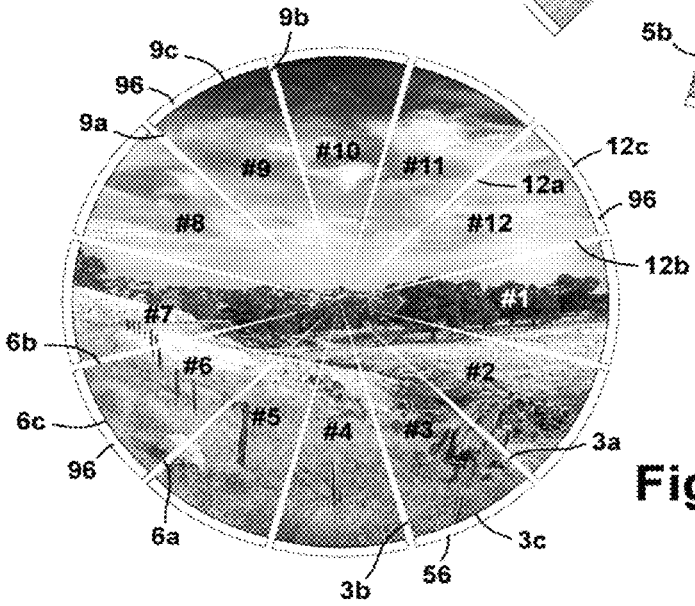

Given the vagaries of photo manipulation software, adjusting the areas or panels of the image to fit the layout guide is most easily and accurately accomplished when the panels to be adjusted are aligned either horizontally or vertically. Thus, for the best results in this particular example, the areas of the image for panels #1, #4, #7, and #10 are adjusted with the image in its original position, as illustrated in FIG. 49. The image is then rotated 30 degrees, and the areas for panels #2, #5, #8, and #11 are adjusted, as shown in FIG. 50, following which the image is rotated another 30 degrees, and the areas for panels #3, #6, #9, and #12 are adjusted. When the images for all of the panels have been duplicated and adjusted, the resized image is rotated back to its original orientation, as seen in FIG. 51.

The layout guide is then turned off, and the image is cropped just outside the outer edges of the mounting tabs to reduce file size.

Figure 52:
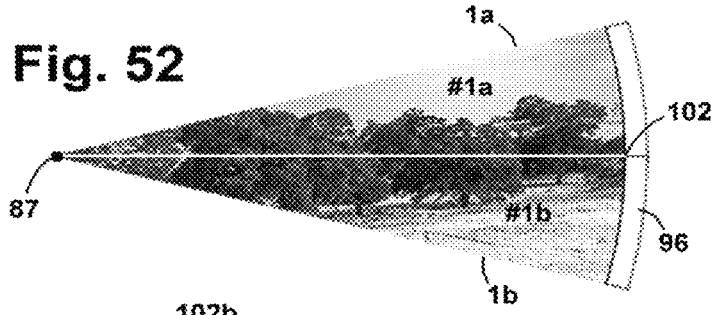
FIGS. 52-55 are enlarged, fragmentary, plan views illustrating additional steps in the creation of the adjusted two-dimensional image for use in the diorama in the embodiment of FIG. 41.
Figure 53:
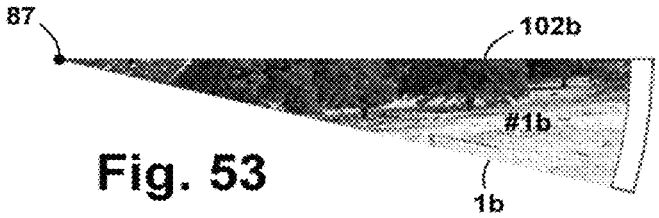

As in the other embodiments, it is necessary to have at least one seam in the image between the focal point and the outer edge in order for the flat printout to take its intended shape. In this particular example, a horizontal line through panel #1 is the best location for the seam because it is generally easier to disguise or mask a seam in dark areas. Thus, as illustrated in FIG. 52, a seam line 102 extends across panel #1 from focal point 101 to the outer edge of the panel, dividing the panel into an upper section #1*a* and a lower section #1*b*. An image of the upper section is created by selecting that section and duplicating it with the photo manipulation software. The image thus created is then used to mask off the upper section of the original image and thereby create an image of the lower section that matches precisely with the image of the upper section.

Figure 54:
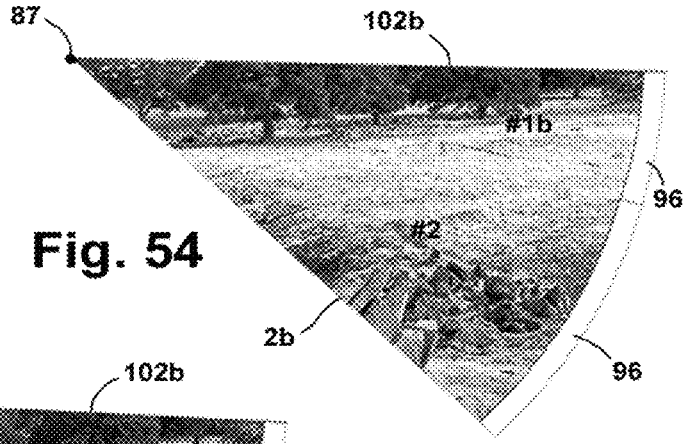
Figure 55:
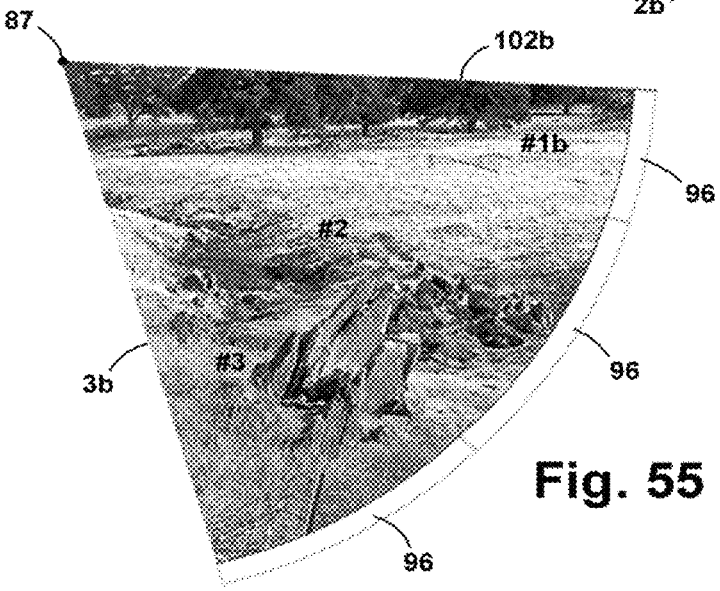

Using the photo manipulation software and with upper section #1*a* selected as the anchor panel, lower section #1*b* is rotated about the focal point and away from seam line 102 until the lower edge 1*b* of the section is aligned precisely with the facing edge 2*a* of panel #2 and the image flowing smoothly and continuously between the panels, as seen in FIG. 54. The rotated section is linked with panel 2, and the two are rotated together to bring edge 2*b* into precise alignment with edge 3*a* of panel #3, as shown in FIG. 55. The process is repeated until the facing edges of all of the panels have been brought together and the blended image flows smoothly and continuously across the panels from one side of the seam line to the other, as shown in FIG. 56, with the only discontinuity being a gap 103 between the upper and lower sections of panel #1.

Figure 58:
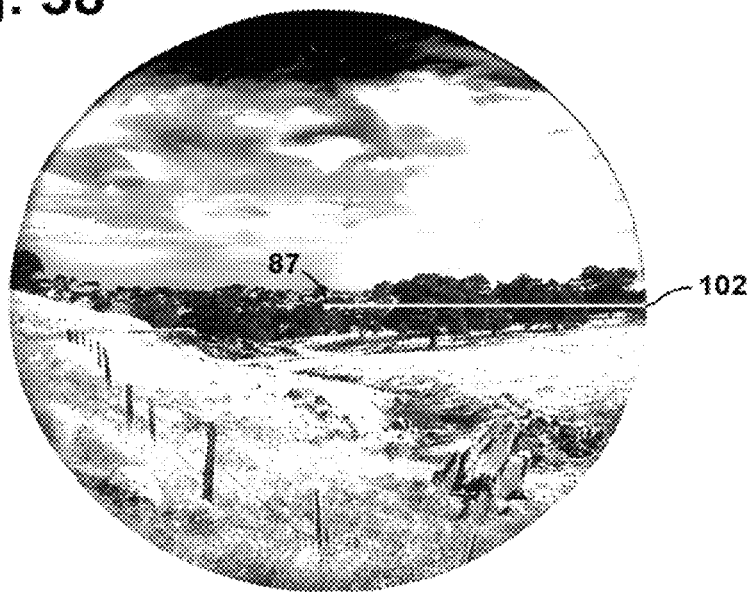
FIG. 58 is front elevational view of the diorama in the embodiment of FIG. 41 with a reference line added to indicate the seam which permits the diorama to have its three-dimensional shape.
Figure 59:
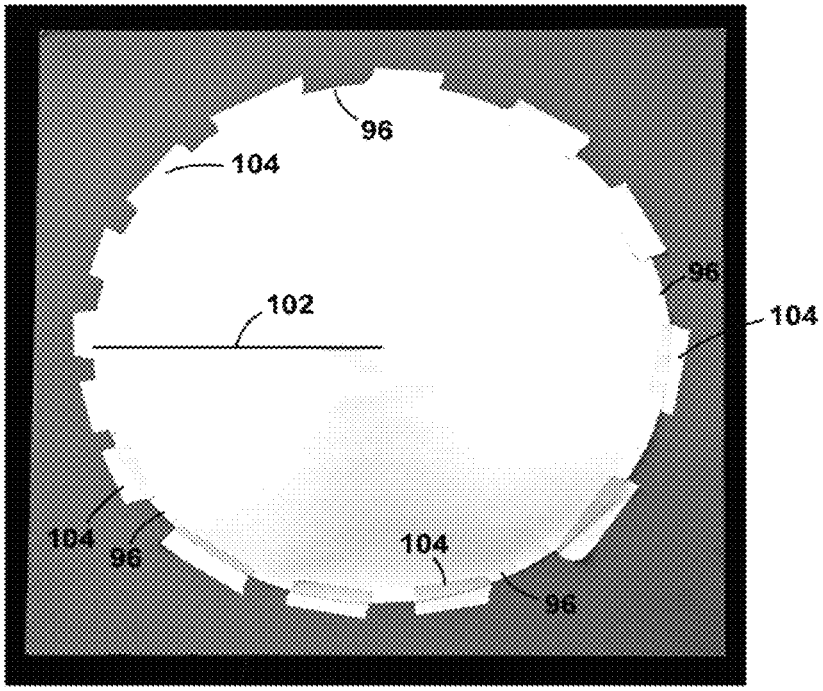
FIG. 59 is a rear elevational view of the embodiment of FIG. 41

The blended image is printed, and the flattened diorama thus created is trimmed about the mounting tabs and along the edges 103*a*, 103*b* of the two sections at the gap, with particular attention being given to the edges of the two sections to make sure they are cut precisely. The mounting tabs are cut into smaller sections 96*a*-96*f*, as seen in FIG. 57, to facilitate forming the printed image into its three-dimensional shape, with the edges 103*a*, 103*b* of sections #1*a*, #1*b* back together along seam line 103, as seen in FIGS. 58 and 59, and secured by suitable means such as tape (not shown). The completed diorama is placed behind the mat and attached to the mat with strips of tape 104 or by other suitable means.

The invention has a number of important features and advantages which allow a two-dimensional photograph or other image to be readily converted to a three-dimensional diorama that creates a perspective effect which greatly augments the illusion of depth, and with no physical seams between the panels on which it is displayed, the image flows smoothly and continuously between the panels.

The diorama can be of any size and/or shape desired, as can the focal zone or focus and the panels on which the image is displayed, with a greater number of panels generally providing smoother transitions between the areas of the image displayed on them. Multiple focal zones can also be used with images having more than one area of focus. For example, with an image of a large room having openings in the main background or openings to other rooms off to the sides of the main room, the large room itself could be displayed on one diorama, with the other rooms being displayed on smaller dioramas in the openings.

It is apparent from the foregoing that a new and improved diorama and method of making the same have been provided. While only certain presently preferred embodiments have been described in detail, as will be apparent to those familiar with the art, certain changes and modifications can be made without departing from the scope of the invention as defined by the following claims.

The invention claimed is:

1. A method of transforming a two-dimensional image into a diorama having a focal zone and a plurality of panels which are inclined outwardly from the focal zone, comprising the steps of: constructing a layout guide in the form of a two-dimensional projection of the diorama with guide lines diverging outwardly from the focal zone and outlining two-dimensional projections of the panels, superimposing the layout guide on the two-dimensional image with the focal zone in registration with a focal area of the image, selecting areas of the image for display on the panels of the diorama, creating an adjusted image having panels in which the selected areas are adjusted in size and/or shape to fit precisely within the guide lines for the panels of the diorama, selecting an anchor panel which remains fixed in place with the focal area of the adjusted image, rotating the other panels of the adjusted image about the focal area from a seam line toward the anchor panel to separate the image at the seam line and bring facing edges of adjacent image panels together to form an image that extends continuously across the panels from one side of the seam line to the other, printing the image with the rotated panels, trimming the printed image along the edges of the image where it was separated at the seam line, and bringing the trimmed edges together along the seam line to form a three-dimensional image.

2. The method of claim 1 wherein the focal zone is rectangular.

3. The method of claim 1 wherein the focal zone is a line.

4. The method of claim 1 wherein the focal zone is a point.

5. The method of claim 1 wherein the layout guide is constructed by graphically constructing a three-dimensional model of the diorama and constructing a two-dimensional projection of the three-dimensional model.

6. The method of claim 1 wherein the areas of the image selected for display on the panels of the diorama are defined by lines extending from the focal area to outer corners of the two-dimensional image.

7. The method of claim 1 wherein the anchor panel and the seam line are located on opposite sides of the focal area.

8. The method of claim 1 wherein the panels of the adjusted image are rotated about centers located at intersections of diverging lines along the facing edges of adjacent ones of the image panels.

9. The method of claim 1 wherein and first and second anchor panels are selected, two of the other panels are divided along seam lines that extend between the background panel and the periphery of the adjusted image, one group of the image panels is rotated from the seam lines toward the first anchor panel, a second group of the image panels is rotated from the seam lines toward the second anchor panel, the printed image is trimmed along facing edges of the image where it was separated at the two seam lines, and the trimmed edges are brought together along the two seam lines to form the three-dimensional image.

10. The method of claim 9 wherein the background panel is rectangular, and the seam lines are located on opposite sides of the rectangular panel.

11. A method of making a diorama, comprising the steps of:

creating a two-dimensional image having a focus and a plurality of sections disposed about the focus with facing edges of adjacent sections diverging outwardly from the focus, selecting one of the sections as an anchor section, establishing a seam line that extends between the focus and an outer edge of the image, rotating the sections about the focus from the seam line toward the anchor section to separate the image at the seam line and bring the facing edges of adjacent sections together to form an image that extends continuously across the sections from one side of the seam line to the other, printing the image with the rotated sections, trimming the printed image along the edges where the image was separated at the seam line, and bringing the trimmed edges together along the seam line to form a three-dimensional image having sections that are inclined outwardly from the focus with the image flowing smoothly and continuously between the sections and no other seams between the sections.

12. The method of claim 11 wherein each section of the two dimensional image is created by constructing an orthographic projection of a corresponding section of the three-dimensional image as it will appear in the diorama.

13. The method of claim 11 wherein the portion of the two-dimensional image in each section is adjusted for enhanced perspective effect and to make the image flow smoothly and continuously between the sections when the sections are rotated to bring the facing edges of the sections together.

14. The method of claim 11 wherein the two dimensional image is created by the steps of:

constructing a three-dimensional model of the diorama with panels corresponding to the sections of the three-dimensional image inclined outwardly from a focus and adjacent edges of the panels coming together along corner lines, converting the three-dimensional model to a two-dimensional layout guide with lines corresponding to the corner lines of the model diverging from a focus and outlining two-dimensional orthographic projections of the panels, adjusting images of contiguous areas of an image to be transformed into the diorama to match the size and shape of the orthographic projections of the panels on the layout guide, and arranging the adjusted images in accordance the layout guide to form the sections of the two-dimensional image.

15. The method of claim 11 wherein the focus is an area.

16. The method of claim 11 wherein the focus is a line.

17. The method of claim 11 wherein the focus is a point.

18. The method of claim 11 wherein a plurality of the sections of the two-dimensional image are selected as anchor sections, a plurality of seam lines are established, the image sections are rotated away from the seam lines toward the anchor sections to separate the image at the seam lines and bring the facing edges of adjacent sections together, the printed image is trimmed along facing edges of the image where it was separated at the seam lines, and the trimmed edges are brought together along the seam lines to form the three-dimensional image.

* * * * *